US009470038B2

(12) United States Patent
Ona-Gonzalez et al.

(10) Patent No.: US 9,470,038 B2
(45) Date of Patent: Oct. 18, 2016

(54) WINDBREAK SYSTEM

(75) Inventors: Francisco Ona-Gonzalez, Malaga (ES); Jorge Luis Perez-Falcon, Malaga (ES)

(73) Assignee: ALLGLASS CONFORT SYSTEMS S.L., Malaga (ES)

( * ) Notice: Subject to any disclaimer, the term of this patent is extended or adjusted under 35 U.S.C. 154(b) by 145 days.

(21) Appl. No.: 14/126,448

(22) PCT Filed: Jun. 24, 2011

(86) PCT No.: PCT/ES2011/000210
§ 371 (c)(1),
(2), (4) Date: Jun. 16, 2014

(87) PCT Pub. No.: WO2012/175754
PCT Pub. Date: Dec. 27, 2012

(65) Prior Publication Data

US 2014/0326419 A1 Nov. 6, 2014

(51) Int. Cl.

| | |
|---|---|
| ***E05D 15/26*** | (2006.01) |
| ***E06B 9/00*** | (2006.01) |
| ***E04F 11/18*** | (2006.01) |
| ***E05D 15/06*** | (2006.01) |
| ***E05D 15/58*** | (2006.01) |
| ***E04H 15/00*** | (2006.01) |
| *E04B 1/00* | (2006.01) |
| *E06B 3/50* | (2006.01) |

(Continued)

(52) U.S. Cl.
CPC ..... *E06B 9/00* (2013.01); *E04F 11/1853* (2013.01); *E04H 15/005* (2013.01); *E05D 15/0604* (2013.01); *E05D 15/58* (2013.01); *E06B 3/5054* (2013.01); *E04B 1/003* (2013.01); *E04B 2/827* (2013.01); *E05Y 2201/64* (2013.01); *E05Y 2201/684* (2013.01); *E05Y 2900/132* (2013.01); *E05Y 2900/15* (2013.01); *E06B 3/509* (2013.01); *E06B 3/924* (2013.01); *E06B 2009/005* (2013.01)

(58) Field of Classification Search
CPC ..... E06B 9/00; E06B 3/5054; E04F 15/005; E04F 11/1853; E05D 15/0604; E05D 15/58
USPC ..... 49/125, 127, 128, 129, 130, 436, 428
See application file for complete search history.

(56) References Cited

U.S. PATENT DOCUMENTS 527,239 A * 10/1894 Garfield ..... G07D 9/002 109/46
5,548,926 A * 8/1996 Sjoholm ..... E05D 15/58 49/125

(Continued)

FOREIGN PATENT DOCUMENTS

ES 2365575 B1 * 8/2012 ..... E05D 15/0608

*Primary Examiner* — Katherine Mitchell
*Assistant Examiner* — Abe Massad
(74) *Attorney, Agent, or Firm* — Hoglund & Pamias, PSC; Roberto J Rios

(57) ABSTRACT

The invention relates to a windbreak system formed by: a set of independent panels that can be controlled individually, by moving the same longitudinally along an upper rail and a lower rail: and a folding door at one of the ends. Each panel and door comprises a rotation shaft and a folding shaft. The panels are moved manually, without bearing on rollers, and the entire weight of the panels rest on two strips of self-lubricating polymers that are inserted into two slots in the lower rail. The upper and lower rails are identical and have a rectangular cross-section and the panels are made from glass.

9 Claims, 19 Drawing Sheets

(51) Int. Cl.
*E04B 2/82* (2006.01)
*E06B 3/92* (2006.01)

(56) References Cited

U.S. PATENT DOCUMENTS 5,749,172 A * 5/1998 Isopahkala ..... E05D 15/0604 49/124
6,301,833 B1 * 10/2001 Airikkala ..... E05D 15/58 160/196.1
6,397,522 B1 * 6/2002 Nussbaum ..... E05D 15/58 49/127
6,553,715 B1 * 4/2003 Lonnberg ..... E05D 15/0608 160/196.1
7,260,916 B2 * 8/2007 Sarnell ..... E04B 2/827 160/196.1
8,978,302 B2 * 3/2015 Ona Gonzalez .... E05D 15/0608 49/125
2012/0061033 A1 * 3/2012 Ona Gonzalez .... E05D 15/0608 160/205
2013/0306251 A1 * 11/2013 Ona Gonzalez .... E05D 15/0608 160/127
2015/0284949 A1 * 10/2015 Hilliaho ..... E06B 3/924 52/204.1

* cited by examiner

WINDBREAK SYSTEM

FIELD OF THE INVENTION

The present invention is an improvement to the international application PCT/ES2010/000187 "WINDBREAK SYSTEM". This invention is directed to the technical field of building systems or materials.

BACKGROUND OF THE INVENTION

International application PCT/ES2010/000187 "WINDBREAK SYSTEM" (incorporated herein by reference) discloses the most significant related prior art patents. This invention contains a set of independent panes that can be individually operated sliding them along a top and bottom track and a foldable door. Each pane and door has a pivot axis and a folding axis. Panes are operated manually and have no bearings, resting the weight of the panes over two self-lubricating polymer strips, inserted in two channels in the bottom track. The operation of the system is based in a set of elements that allow the panes to fold and slide along the tracks in order to achieve the best isolation and best durability.

SUMMARY OF THE INVENTION

The present invention comprises the following changes and enhancements in comparison to international application PCT/ES2010/000187:

1. New top and bottom profiles, replacing the top and bottom profiles used on PCT/ES2010/000187.
2. A leveling system has been added, formed by a leveling profile and a set of eccentric nuts and screws used for keeping together the bottom track and the leveling profile.
3. New top and bottom turning sets similar to the ones used on PCT/ES2010/000187 are provided.
4. A new top guide is provided for replacing the one used on PCT/ES2010/000187.
5. Caps are added to the bottom track ends.
6. A new door locking systems mechanism is provided for replacing the one used on PCT/ES2010/000187.
7. The turning mechanism has a new set of components.
8. A two-part adjustable corner plate has been added to ease coupling two sections of the system that form a corner.
9. A new top turning set is provided for facilitating pivoting of the panels avoiding the use of a guide-arm.
10. A new replacement bottom guide is provided.
11. A corner wedge that fits into the two-part adjustable corner plate has been added.

The first addition corresponds to the new top profile that has a flat base and side arms, with small protuberances up to 0.5 mm long on their inner faces, for improving the coupling between the glass and the aluminum profile. Both arms have a cavity on the top area for collecting the excess of glue that could leak out of the profile during the gluing process. The ends of these arms have two flat opposing sides that conceal the bonding material that bonds the glass and the aluminum from external viewing. The bottom area of the profile has an inverted "U" shape hole for inserting and securing the top turning set and top guide set.

The second addition corresponds to a new bottom profile that has a flat base and side arms having teeth-like protuberances with a size of up to 0.5 mm on their interior surface for improving the bonding between the glass and the aluminum profile. The bottom area of the profile has an inverted "U" shape hole for inserting bolts used to couple this profile to the bottom sliding profile base and allow regulating the height of this profile with respect to the other one in order to compensate for the glass imperfections introduced during the glass cutting process.

The third addition corresponds to a new "U" shape leveling profile that accommodates leveling sets formed by an eccentric bolt and a flat head screw. The screw has a circular head with a diameter large enough to provide a stable support for the aluminum track; the height of the screw is designed to level the track on uneven floors or ceiling surfaces. The eccentric bolt has the appropriate dimensions to fit perfectly inside the leveling profile base to avoid any undesired movement and providing a stable support base for the entire system. The bottom track is positioned on top of the leveling sets. The arms of the leveling profile serve to center the track and hide the leveling sets and fixation screws. The leveling profile base has two corner holes receiving a cap that prevents water leakage towards the interior of the installation.

The fourth addition corresponds to a new top turning set having a metal body and a top guide bushing. The base of the metal body comprises a plate with three layers and a protuberance. The first layer ensures proper coupling between the panes when they are being deployed. This layer has a reference mark indicating the correct position to fix this set guarantying the longitudinal position of the set with respect to the top profile. The second layer includes small teeth-like protuberances of up to 0.5 mm long for completely securing the set to the aluminum top profile. The width of the third layer ensures a centered position of the set in relation to the pane since it has the same width as the top profile opening. The protuberance has a wedge shape for supporting the set body and ensuring that an axis of the set is in a vertical position in relation to the top aluminum profile, eliminating the need for a second screw used in the prior art. The top guide bushing has a circular shape and two layers and it is made as a single piece of polyamide or similar material. This bushing is inserted by pressure into the rounded metal head of the top turning axis. The larger diameter of the bushing ensures centering the pane in relation to the track and avoids the noises generated when the panes are sliding.

The fifth addition corresponds to a new bottom turning set having a metal part with two bodies and a bottom guide bushing. The metal part is formed by two bodies joined by an arrow-type locking, also known as a "click", that allows the insertion but not the removal of one part with respect to the other, creating a completely rigid union between the parts preventing disassembled. The base of the metal body comprises a plate with three layers and a protuberance. The first layer ensures the right coupling between the panes when they are being deployed. This layer has a reference mark indicating the correct position to secure the bottom guide set to the aluminum profile guarantying the longitudinal position of the set with respect to the bottom profile. The second layer includes small teeth-like protuberances of up to 0.5 mm long for completely securing the set to the aluminum bottom sliding profile. The width of the third layer corresponds to the width of the bottom sliding profile opening ensuring a centered position of the set in relation to the bottom sliding profile. The wedge-shape protuberance supports the set body ensuring that an axis of the set is vertically positioned in relation to the bottom aluminum sliding profile eliminating the need for a second screw used in a previous version of this set. The bottom guide bushing has a "T" shape, wherein the lateral surfaces are flat and the front and rear surfaces are round. The width of the bushing is smaller than the aluminum track opening, allowing the panes to be mounted and dismounted without the need of a hole in the track. The bottom guide bushing is centered in relation to the set axis and is not fixed so that the flat sides of the bushing and the aluminum track can be maintained in parallel position.

The bottom guide set solves a current problem present during the installation process of the previous system, since it was necessary to insert a metal pin inside the plastic bushing, a delicate process in which sometimes the plastic bushing ended broken. This breaking could also happen by an improper operation of the panes or when a foreign object accidentally falls inside the track breaking the plastic piece during the normal operation of the system. This situation required dismounting the complete system since the bushing can't be inserted into the track from top to bottom and it has to be done from a lateral side. Therefore, there is no need to provide a specific hole in the track for inserting this piece into the bottom guide as the invention allows the top to bottom insertion into the track. Therefore, the bushing dimensions allow mounting and dismounting the panes without the need of a hole in the track for inserting these pieces.

The sixth addition corresponds to a new top guide set having a metal body and a top guide bushing. The base of the metal body comprises a plate with two layers and a protuberance. The first layer comprises small teeth-like protuberances of up to 0.5 mm long for completely securing the set to the aluminum top profile. This layer has a downward slope at its front end to facilitate the movement of the set along the top profile needed for its positioning. The width of the second layer corresponds to the top profile opening ensuring a centered position of the set in relation to the top profile. The wedge-shape protuberance serves as a support for the set body ensuring an axial vertical position in relation to the top aluminum profile and eliminating the need for a second screw used in the previous version. The top guide bushing has a circular shape and two layers and it is formed as a single piece made of polyamide or similar material. This bushing is inserted by pressure into the cylindrical metal head. The outer diameter of the bushing ensures the centered position of the pane in relation to the track and avoids noises when the panes are sliding.

The seventh addition consists of providing a cap at both ends of the bottom track. The shape of the cap is the same as the track hole, so that it can fit at the track ends. Small draining holes are provided at the bottom track on the outside surface. This way the track can dispose of any water leaking from the panes unions.

The eighth addition consists of a new top locking block that replaces the locking mechanism used in the previous system described on PCT/ES2010/000187 (incorporated herein by reference). The block has a base with a protuberance for positioning the block perpendicularly to the top aluminum profile, eliminating any possible movement of this block. In the front side there is another protuberance acting as a stopper against the interior side of the top aluminum profile, positioning the door in relation to the top aluminum track. This way, the door is aligned with the rest of the panes. Both protuberances position the block in relation to the top aluminum profile and the top track, avoiding accidental marks or scratches on the outer faces of these profiles during the installation.

The ninth addition consists of a new pivot block and a turning mechanism set the replaces the previous turning mechanism used on the system described on PCT/ES2010/000187. This new set comprises a pivot block and a turning mechanism assembled together forming a single body. The new pivot block replaces the cubic pivot made of polyamide used on the top and bottom turn mechanisms described on PCT/ES2010/000187. The pivot block has a rectangular or square shape in all its sides, and a slightly off-center hole as the top and bottom axes must be shifted between them for the correct operation of the system. There are two sides with a protuberance and a hole each, on their bottom. These shapes, identical to all the pieces, are used to assemble the components in the new turning mechanism. The new turning mechanism has plates each with two spoon-shaped areas, or half moons, wherein all these plates have identical protuberances for the assembly among them and to the pivot block.

The new turning mechanism and pivot block set can be used on the top and bottom part of the windbreak system and in any other possible opening configuration without any mechanical operation of the components. To achieve this, the pivot block on the bottom must be assembled to the spoons plate using a different protuberance than the one used in the top pivot block, as the axis hole position is not symmetrical in the longitudinal axis defined by the longest sides of the block. This way, the installation process of the present invention is easier and more reliable than the one described on PCT/ES2010/000187.

The tenth addition consists of including a two-part adjustable corner plate used to couple different sections, such as when there is an angle and two tracks must be connected. Moreover, the two-part adjustable corner plate ensures that both sections won't separate from each other during the operation of the system once they are assembled. The two-part adjustable corner plate has two identical plates connected by a joint element in the round-shaped lower end of the plates. These semicircular ends have a step so that they can be coupled by means of the joint element. This step is limited by two straight edges forming an interior angle of 270° that allows the set to be used for connecting sections having an angle within a range of 45° to 315°. The other small side is straight. An oval hole is positioned along the imaginary central axis of the plates, whose longer axis is parallel to the longer sides of the plates, and another circular hole, wherein the oval holes are closer to the small straight side of the plates.

The oval-shaped hole is used to first position the two plates on each one of the two sections to be coupled allowing regulation on the connection process of the tracks. The second hole is used for the final securement once the tracks are connected properly.

The eleventh addition consists of a new top turning set that eliminates the need of using the guide-arm when folding the panes. This new set is formed by a metal axis and a blocking bushing. The metal axis has a cylindrical shape. The bottom area of the axis has a semicircular shape to be inserted into a fixing plate. Around the middle of the axis there are two wings connected, with a ramp shape. This ramp will allow the blocking bushing to go up the axis until it reaches the pivot position at the top turning mechanism height. At the top of the axis there is a head with a small ramp that will press the blocking bushing down the axis when the pane is going to be deployed, so it can leave the top turning mechanism. The front side of the head has a rounded shape and will block the pane is folded as the axis rotates approximately 90° in relation to the blocking bushing.

The blocking bushing has two layers. The first layer, with a larger diameter, has a ramp that will elevate the bushing, when in contact with the axis ramp, up to the top turning mechanism height. The second layer is symmetric to the central vertical axis and has an interior ramp in the inner hole and two rounded sides to block the metal axis head when it starts the rotation movement. When the pane is going to be deployed the central ramp in the blocking bushing will slide downward over the axis head ramp and will move down the blocking bushing, therefore leaving the top turning mechanism.

The twelfth addition corresponds to a new bottom guide, having a metal plate and a washer, made of polyamide or similar material that replaces the one used on PCT/ES2010/000187. The base of the metal body is a plate with two layers. Small, teeth-like protuberances of up to 0.5 mm high are provided on the first layer to complete couple the set to the aluminum bottom profile. The opposite side of the first layer base has a channel with a width equal to the width of the opening of the aluminum bottom profile, so they are both aligned. The second layer has a height equal to the thickness of the base of the bottom profile, so that when this plate is fixed, the layer will be at the same level as the base of the bottom profile, effectively making the base at this point a flat continuous surface. The plate is made as a single piece by injection to ensure that all the dimensions and symmetries are correct. This way, the set will work properly and will eliminate the minor measurements or dimension differences among the plates produced in different batches.

The washer is made of polyamide and has a round shape and a hole along its vertical axis, having two layers with different diameters. The larger diameter layer is designed to keep the pane aligned with the aluminum bottom track. The washer head has a smaller diameter than the piece and is used to couple with the metal body, by an arrow-locking system or "click", preventing these pieces from separating. Nevertheless, the washer can rotate freely as its cylindrical interior hole matches a cylindrical pin provided on the first layer of the metal body and with a height equal to the second layer. This new bottom guide set eliminates the need of making a notch in one of the two sliding strips inserted in the bottom track, making this support area completely flat and continuous. This way the base of the bottom profile won't hit or get stuck in the sliding strips during the pivoting movement, providing a smoother operation of the system. In addition, the possibility of damaging the strips while folding the panes is eliminated.

The thirteenth addition consists of a wedge that has three layers with a rounded side. The first layer is a base placed below the two-part adjustable corner plate. It has a rounded side that allows the plates to move while connecting two tracks, and at the same time, keeps the wedge at a fix position when the panes move along the corner. The second layer connects the first and third layer and fills a gap between the corner and the rounded plates when connecting two sections with angles. The third layer has a rounded shape for avoiding the bottom turning bushing to get stuck in the corner and moves smoothly along the tracks from one section to another.

The following parts are made as a single piece by injection to ensure the correct measurements for a perfect coupling among the parts and eliminate possible flaws in the different fabrication batches:

Top turning set metal body
Two metal bodies in the new bottom turning set
Caps for the track ends
New locking block
Pivot block and turning mechanism
Two-part adjustable corner plate
Metal axis and blocking bushing in the new top turning set
Plate in the new bottom guide
Wedges that make easier the coupling of this part with the two-part adjustable corner plate The material used for these metal bodies can be aluminum, stainless steel or other metallic alloy.

BRIEF DESCRIPTION OF THE DRAWINGS

FIGS. 20 and 21: Turning mechanism module top plan and side elevation.

DETAILED DESCRIPTION OF THE DRAWINGS

Figure 1:
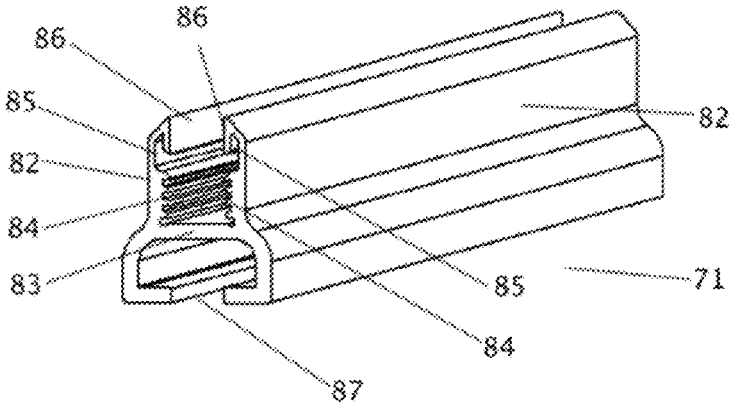
FIG. 1: Top profile side elevation.

The present invention will use the following reference numbering based on the system described on PCT/ES2010/000187:

1. Pane (1)
2. Glass (2)
3. Trapezoidal aluminum top profile (3) of the pane (1).
4. Trapezoidal aluminum bottom profile (4) of the pane (1).
5. H-shaped bottom sliding profile (5).
6. Top track (6).
7. Bottom track (7).
8. Strips made of a homogeneous mixture of polymer (8).
9. "T" axis guide (9).
10. Top bushing guide (10).
11. Steel plate (11)
12. Bottom steel plate (12).
13. Bottom "T" axis guide (13).
14. Bottom bushing guide (14).
15. Top and bottom turning mechanism (15).
16. Spoons or half moons (16).
17. Turning mechanism base (17).
18. Top guide bushing (18).
19. Bottom guide "H" washer.
20. Semicircular hole (20) located at one end of the steel plate (11, 12).
21. Steel plate (11, 12) threaded holes (21).

22. Sliding door bottom bushing (22) with five layers and similar to the bottom bushing (14).
23. Guide-arm (23) made of stainless steel.
24. Door (24).
25. Door top cubic pivot (25) made of polyamide.
26. Door top axis screw (26).
27. Door bottom cubic pivot (27) made of polyamide.
28. Door bottom axis screw (28).
29. Screws (29) to fix cubic pivots (25, 27) to the ceiling and floor.
30. Bottom guide screw (30) crossing the top guide bushing (18) and fitting into a threaded hole in the steel plate (11).
31. Sliding door bottom plate (31).
32. Semicircular notch (32) at one end of the sliding door bottom plate (31).
33. Opening (33).
34. "T" axis head (34).
35. Bottom lock (35) of the door (24).
36. Top aluminum profile (3) side arms (36).
37. Side arms (36) protuberances (37).
38. Flat base (38) in top aluminum profile (3) of pane (1).
39. Top aluminum profile (3) hole (39).
40. "H" shape bottom aluminum profile (4) side arms (40).
41. Side arms (40) protuberances (42).
42. Rectangular hole (42) in the half opened bottom profile (4) of pane (1).
43. Straight side arms (43) covering the side arms (40). Side arms (43) are part of the bottom sliding profile (5).
44. Flat base (44) in bottom sliding profile (5).
45. Hole (45) in profile (5) where steel plate (12) is placed.
46. Exterior sides (46) in the base of 5 bottom profile (5).
47. Track side (47) with exterior and interior flat face in top (6) and bottom track (7).
48. Track side (48) with exterior flat face and interior with protuberances (49) in top (6) and bottom track (7).
49. Protuberances (49) on interior track side (48).
50. Screws or bolts (50) to fix the top (6) and bottom track (7) to the ceiling and floor.
51. Longitudinal channel (51) in top (6) and bottom track (7).
52. Longitudinal channel (52) in top exterior side (57) close to side (47).
53. Longitudinal channel (53) in top exterior side (57) close to hole (56).
54. Longitudinal channel (54) in top of exterior side (57) in side wall (48).
55. Wind and water protecting brushes (55).
56. Opening (56) of top (6) and bottom track (7).
57. Exterior side (57) of top (6) and bottom track (7).
58. Guide-arm (23) hole (58).
59. Door (24) locking mechanism (59).
60. Rod (60) of up and down mechanism for the pin (56).
61. Spring (61) of up and down mechanism for the pin (56).
62. Guide-arm (23) flat side, parallel to the floor and containing two holes (57, 58).
63. Guide-arm perpendicular flat side (63).
64. Horizontal stepped side (64) for fixing through 3 holes (66).
65. Vertical stepped side (65) for fixing through 3 holes (66).
66. Fixing holes (66) on top of interior side of top track (6).
67. Long hole (67) of the sliding door plate (31).
68. Circular hole (68) of the sliding door plate (31).
69. Door (24) locking mechanism (59) fixing hole (69).
70. Steel plate (70) for fixing the door (24) locking mechanism (5).

The present invention describes thirteen (13) modifications to improve the fitting process and the system performance including new versions and additional parts, wherein additional numbering will be used in the explanation below.

The first addition comprises a new top profile (71) is shown in FIG. 1. The glass (2) is glued to the side arms (82) and the flat base (83) of the new top profile (71). These sides (82) have an arm shape, having small teeth-like protuberances (84) on their inner surfaces, to improve the union between the glass (2) and aluminum profile (71). Both arms (82) have a cavity (85) on the top area for collecting the excess of glue that could leak out of the profile during the glass (2) gluing process. The ends of these arms (82) are formed by two opposing flat sides (86) that hide the bonding material fixing the glass and aluminum from the outside view. This way, a wide range of gluing materials, in different formats and colors, can be used. The bottom area of the profile has an inverted "U" shape hole (87) for inserting and fixing the new top turning set (75) and top guide set (77).

Figure 2:
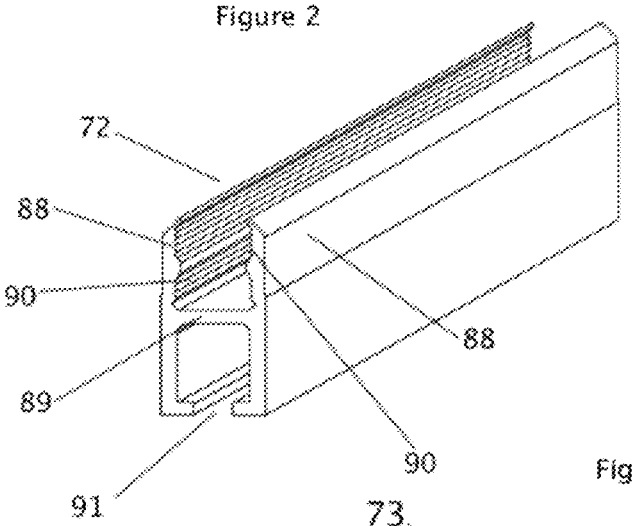
FIG. 2: Bottom profile side elevation.

The second addition corresponds to a new bottom profile (72), as shown in FIG. 2. The glass (2) is glued to the side arms (88) internal faces and to a flat base (89) of the new bottom aluminum profile (72). As in the top profile (71), side arms (88) have, on their interior surface, small teeth-like protuberances (90) of up to 0.5 mm long, for improving the bonding between the glass (2) and the aluminum profile (72). The bottom area of the profile has an inverted "U" shape hole (91) for inserting two bolts (not shown in the figure) that allow fixing this profile to the bottom sliding profile (5) base and allow a height regulation of this profile (72) inside the other one to allow correcting for the glass (2) imperfections originated in the glass cutting process. This makes possible to align a big side of a pane with another or slightly not squared.

Figure 3:
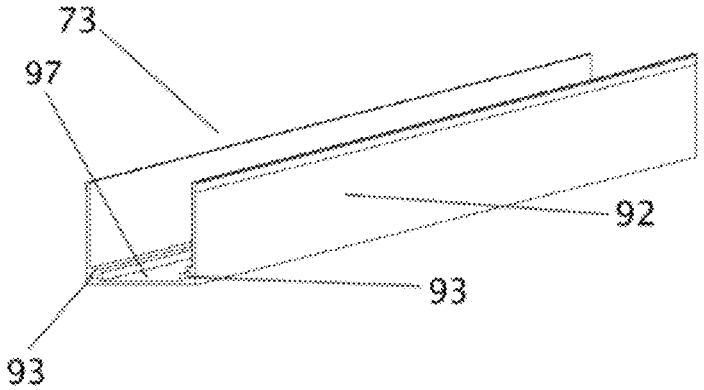
FIG. 3: Leveling profile side elevation.
Figure 4:
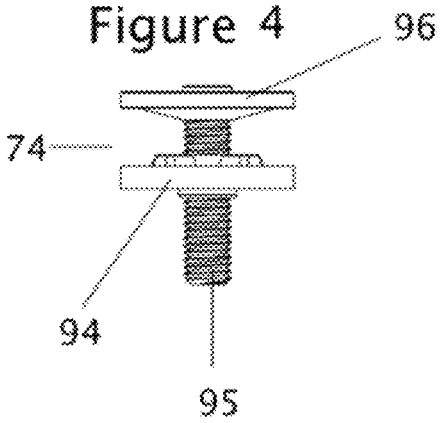
FIGS. 4 and 5: Leveling set side view and side elevation.
Figure 5:
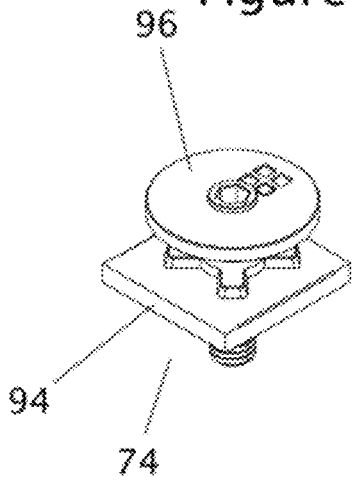

The third addition comprises a new "U" shaped leveling profile (73), as shown in FIG. 3. The leveling profile (73) base (97) accommodates the leveling sets (74), as shown in FIGS. 4 and 5. The leveling set is formed by an eccentric bolt (94) and a flat head screw (95). The screw (95) has a head (96) with a diameter large enough to ensure a stable support for the aluminum track (7), wherein the height of the screw (95) is design to level the track on uneven floors or ceiling surfaces. The eccentric bolt (94) has the precise dimensions to fit completely on the leveling profile (73) base and avoid any undesired movement and also provide a stable support base for the entire system. The bottom track (7) is positioned on top of the leveling sets (74). The side arms (92) of the leveling profile (73) serve to center the track (7) and to hide the leveling sets (74) and fixation screws (50) from plain view. The leveling profile base has two corner holes (93) for inserting a cap (not shown in the figures) to avoid indoor water leakage at the track ends.

The fourth addition corresponds to a new top turning set (75), as shown in FIGS. 4 and 5, having a metal body (97) and a top guide bushing (98). The metal body (97) is made as a single piece by injection, ensuring the part dimensions and symmetries, for a perfect operation and eliminating the possible differences between different production batches.

The base of the metal body (97) is a plate with three layers (100, 101, 102) and a protuberance (103):

First layer (100) ensures the proper coupling between the panes (1) when they are being deployed. This layer (100) has a reference mark (104) for inserting in the correct position this set (75) into the top profile (71), in such a way that all the panes will have the sets fitted at the same distance.

Small, teeth-like protuberances (105) of up to 0.5 mm long are provided on the second layer, to completely couple the set to the aluminum top profile.

The width of the third layer (102) ensures a centered position of the set (75) in relation to the pane (1), since it has the same width as the top profile (71) opening (87).

The wedge-shape protuberance (103) serves as a support for the set body and to ensure the axis (106) is on a vertical position over the top aluminum profile (71), eliminating the need for a second screw previously used in the former version of this set (75).

The top guide bushing (98) has a circular shape and has two layers. It is made of a single piece of polyamide or similar material. This bushing (98) is inserted by pressure into the rounded axis metal head of the top turning set (75). The outer diameter in the bushing (98) ensures the centered position of the pane (1) in relation to the top track (6) and avoids noises when the panes (1) are sliding.

Figure 6:
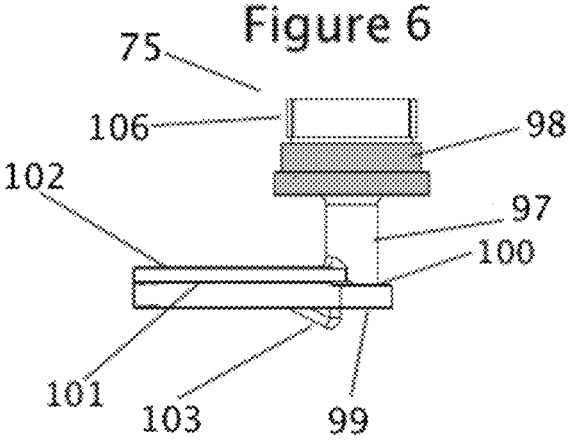
FIGS. 6 and 7: Top turning set side view and side elevation.
Figure 7:
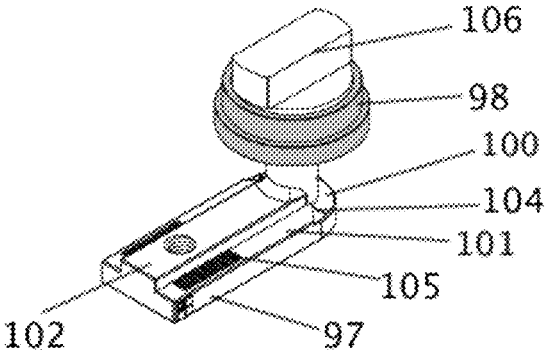
Figure 8:
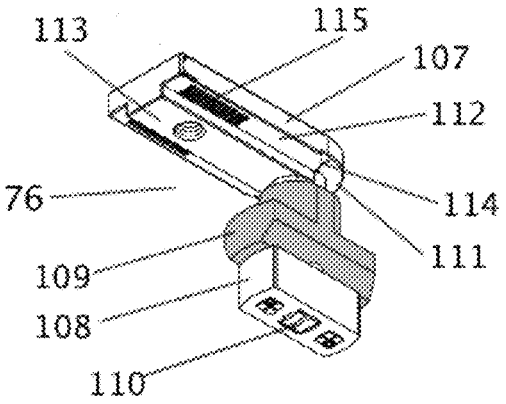
FIGS. 8 and 9: Bottom turning set side view and side elevation.
Figure 9:
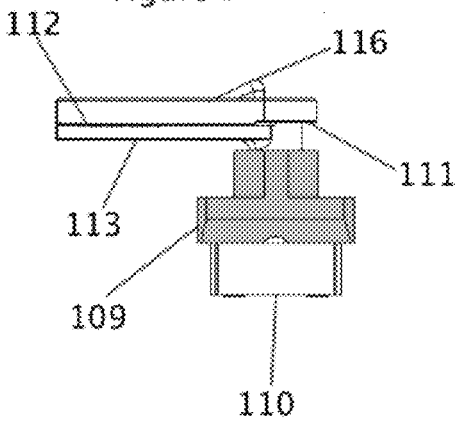

The fifth addition comprises a new bottom turning set (76) that replaces the one previously used in the system described on PCT/ES2010/000187. As shown in FIGS. 6 and 7, the new bottom turning set (76) has a metal part with two bodies (107, 108) and a bottom guide bushing (109). The metal part is formed by two injected metal bodies (107, 108), assembled by a square click locking joint element (110), that allows a part to enter into but not to exit from the other part, creating a rigid union that can't be disassembled. This way, parts dimensions and symmetries are ensured, for a proper operation and possible differences in different production batches are eliminated.

The base of the metal body (107) is a plate with three layers (11, 112, 113) and a protuberance (116):

First layer (111) ensures the proper coupling between the panes (1) when they are being deployed. First layer (111) has a reference mark (114) for inserting this set in the correct position in such a way that all the panes will have the sets (76) provided at the same distance in the aluminum bottom sliding profile (5), and ensuring the right longitudinal position of the set (76) in relation to the bottom sliding profile (5).

The second layer (112) has on its surface small protuberances (115) to completely secure the set (76) to the aluminum bottom sliding profile (5). In other words, the protuberances (115) increase the coupling of the set (76).

The width of the third (111) layer ensures a centered position of the set in relation to the bottom sliding profile (5), since it has the same width as the profile opening.

The wedge-shape protuberance (116) serves as a support for the set body and ensures a vertical position of the axis (110) in relation to the bottom aluminum sliding profile (5), eliminating the need for a second screw used in the previous version of this set.

The bottom guide bushing (109) has a "T" shape; with flat side faces and round front and rear faces. The width of bushing (109) is smaller than the aluminum track (7) opening (56), so that the panes (1) can be mounted and dismounted without the need of a hole in the track (7). The bottom guide bushing (109) is centered in relation to the set axis, but is not fixed, maintaining the flat sides of the bushing (109) and the aluminum track (7) in parallel to each other. The bottom guide set (76) solves a problem present in the previous installation process, as it was necessary to insert a metal pin inside the plastic bushing, a delicate process where the plastic bushing sometimes was broken. In addition, this breaking could happen if the panes were improperly operated or if an object falls inside the track and blocks the normal operation of the bushings. This breakage involved dismounting the whole system as the previous bushing can't be introduced into the track from top to bottom and it has to be done from one side of the track. In the instant invention, there is no need to provide a specific hole in the track as this new version allows the top-down insertion into the track. Therefore, the width of the bushing (109) allows the panes (1) to be mounted and dismounted without the need of a hole in the track in order to insert these new sets inside.

Figure 10:
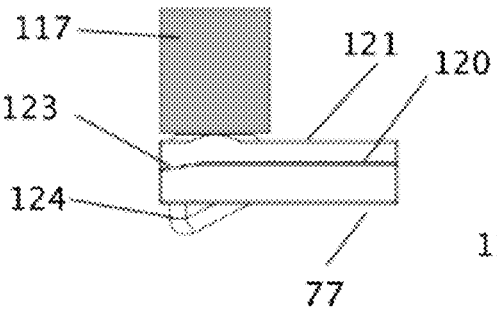
FIGS. 10 and 11: Top guide set side view and side elevation.
Figure 11:
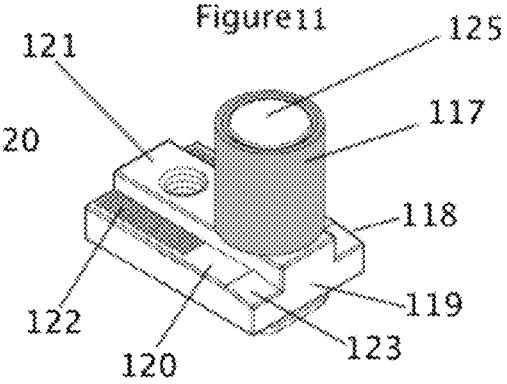

The sixth addition is a new top guide (77) that replaces the one used in the previous system and is made of a bushing (18) and a screw (30). As shown in FIGS. 10 and 11, the new top guide set (77) has a metal body (118) and a top guide bushing (117).

The metal body (118) is made as a single piece by injection, ensuring the parts measurements and symmetries, for a perfect operation and eliminating the possible differences in different production batches. The metal body is a plate (119) with two layers (120, 121), an axis (125) and a protuberance (124). Small, teeth-like protuberances (122) are provided on the first layer (120), to completely secure the set to the aluminum top profile (72). This layer (120) has a downward slope (123) at its front end for easing the movement of the set (75) along the top profile (71) longitudinal hole. The width of the second layer (121) ensures a centered position in relation to the pane (1), since it has the same width as the profile (71) opening. The wedge-shape protuberance (124) serves as a support for the set body and ensuring a vertical position of the axis (125) over the top aluminum profile (71) eliminating the need for a second screw used in the previous version.

The top guide bushing (117) has a circular shape and two layers and is formed as a single piece made of polyamide or similar material. This bushing (117) is inserted by pressure into the cylindrical axis (125) head of metal body (118). The outer diameter in the bushing (117) ensures the centered position of the pane (1) in relation to the track (6) and avoids noises when the panes (1) are sliding.

Figure 18:
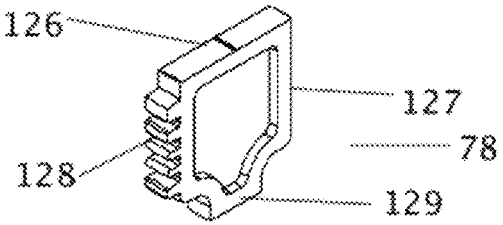
FIG. 18: Cap for track ends side elevation.
Figure 51:
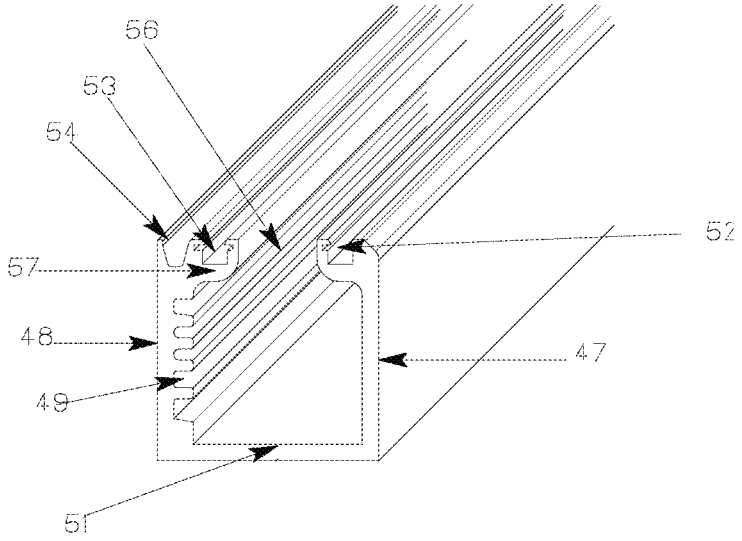
Figure 52:
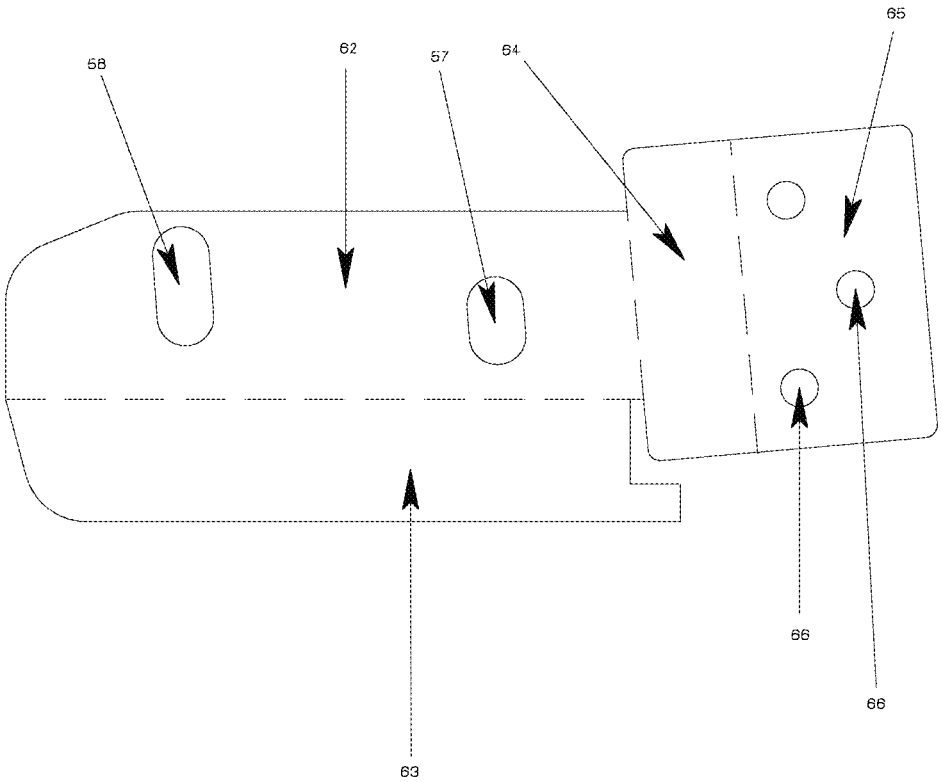
Figure 53:
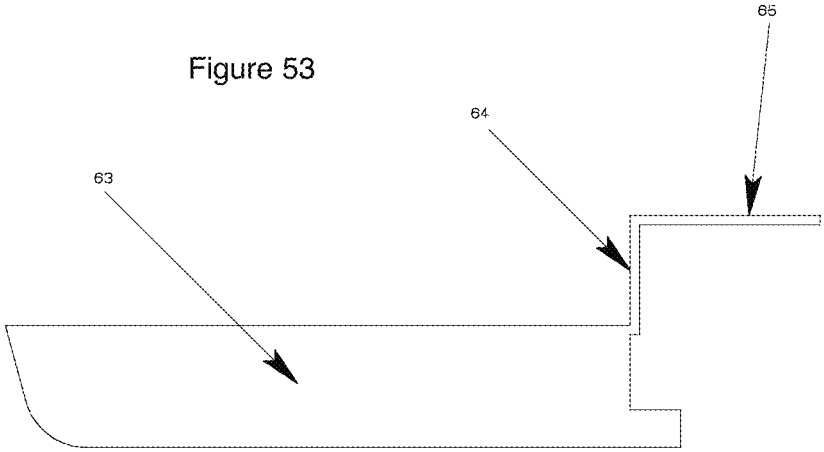

The seventh addition comprises placing a cap (78) at the ends of the bottom track (7). As shown in FIG. 18, the shape of cap (78) is the same as the shape of track (7) hole, so that they fit in perfectly. Therefore, the bottom side (126) is flat and the top side (129) is narrow so that it fits into the hole (56) shown in FIG. 51. One vertical side (127) is flat while the other vertical side (128) has a contour with protuberances so that it fits completely into the protuberances (49) of the bottom track (7). The cap (78) is made as a single piece by injection, ensuring the proper measurements for a perfect coupling to the track (7) and achieving a hermetic termination in the track ends.

Moreover, the bottom track (7) has small holes (not shown in the figures) in the outdoor side. Any water coming into the track (7) from the panes (1) vertical joints can flow outdoor. Therefore, these caps (78) ensure that water will flow through these small holes on the track (7) outdoor side instead of flowing through the track ends, normally in contact with the walls.

Figure 12:
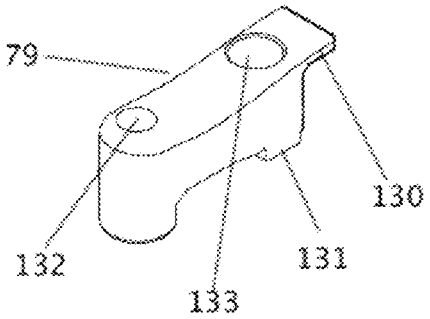
FIGS. 12 and 13: Locking block side elevation 5 and side view.
Figure 13:
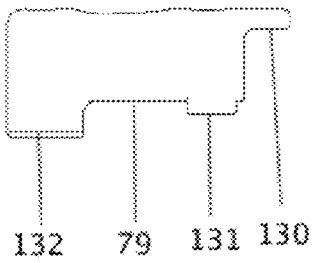
Figure 14:
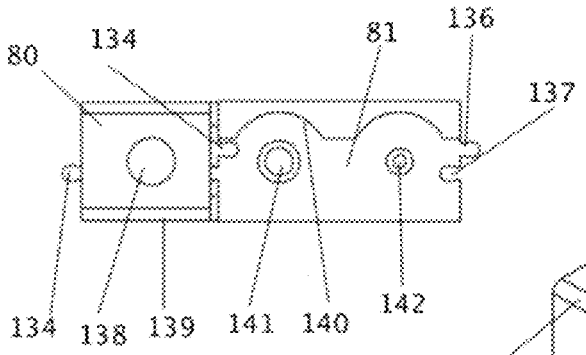
FIGS. 14 and 15: Pivot block and turning mechanism side view and side elevation.
Figure 15:
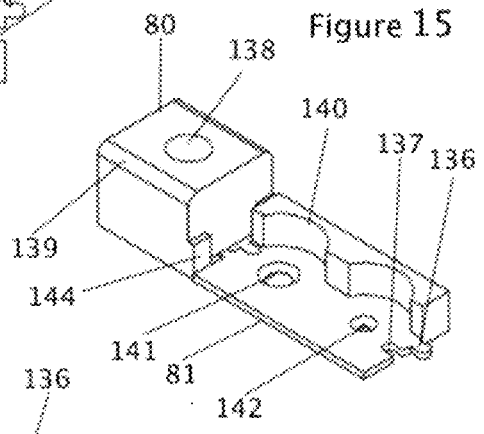
Figure 16:
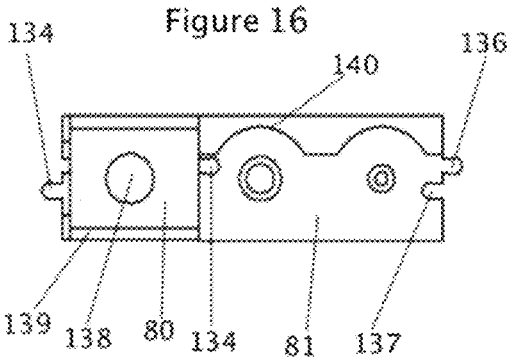
FIGS. 16 and 17: Pivot block and turning mechanism top plan and side elevation in a different configuration.
Figure 17:
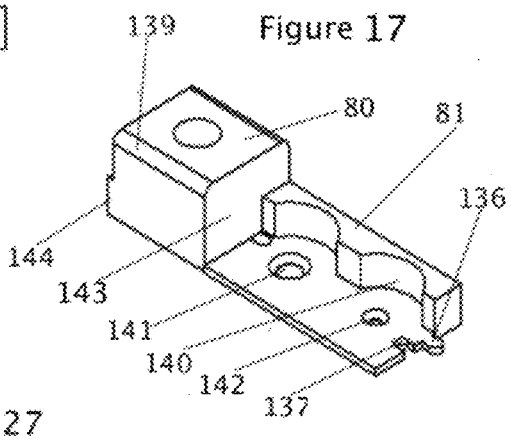
Figure 54:
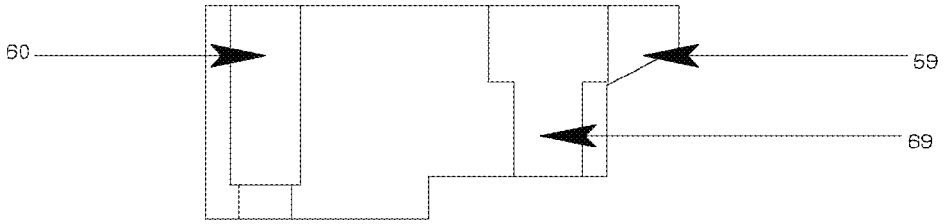
Figure 55:
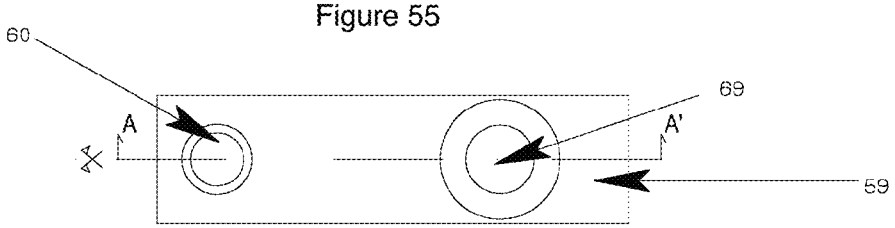
Figure 56:
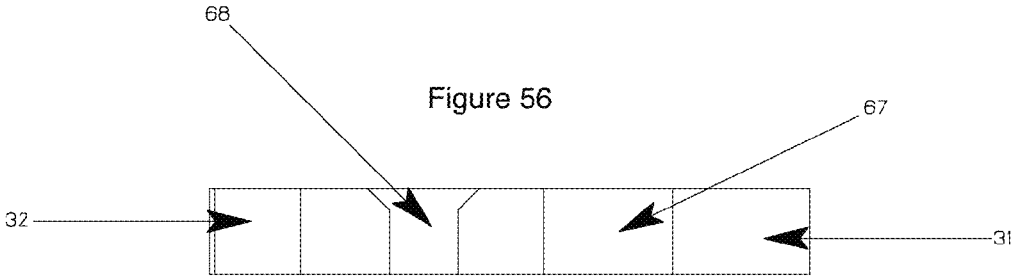
Figure 57:
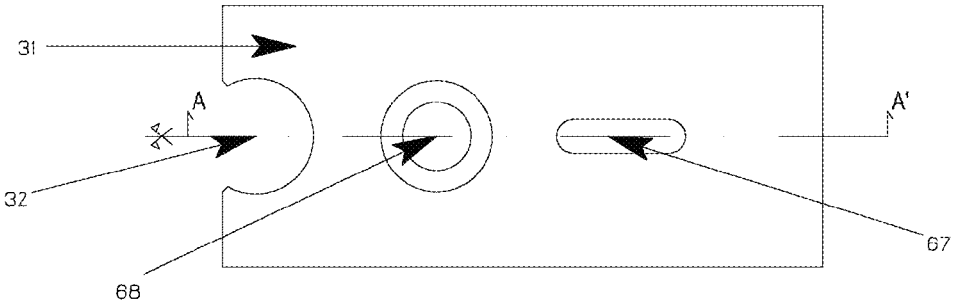

The eighth addition comprises a new top locking block (79) that replaces the previous locking mechanism described in FIGS. 54 and 55. FIGS. 12 and 13 show the new top locking block (79) having on its base a protuberance (130) whose purpose is to position it perpendicularly to the top aluminum profile (71), eliminating any possible movement of this block. In the front side another protuberance (131) is provided serving as a stopper against the interior side of the top aluminum profile (71), positioning the door (24) in parallel in relation to the top aluminum track (71). This way, the door (24) is aligned with the rest of the panes (1). The protuberances (130, 131) position the block in relation to the top aluminum profile (71) and the top track (6), avoiding accidental marks on the outer faces of these profiles (6, 71) during the installation. The block (79) is made as a single piece by injection, ensuring a perfect coupling to the top aluminum profile (71), and avoiding differences in measurements in different production batches. The shape of block (79) is a rectangular parallelogram with two protuberances (130, 131) and a semicircular side with a hole (132) having a greater height with respect to the rest of the block (79). A hole (133) with a diameter greater than the hole (132) is positioned in the opposite side, serving these holes (132, 133) the same purpose as the holes (60, 69) in the door (24) locking mechanism of the previous system.

Figure 19:
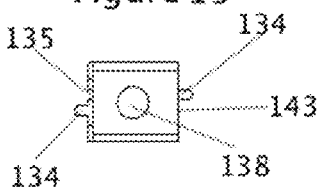
FIGS. 19 and 20: Pivot block top plan and side elevation.
Figure 20:
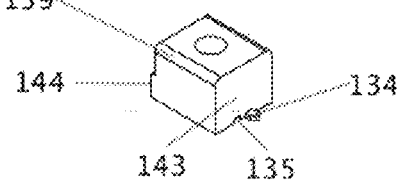

The ninth addition comprises a new pivot block (80) and a turning mechanism set (81) that replaces the turning mechanism (15) used in the previous system. As shown in FIGS. 22 to 29 this new set (80, 81) has two components:

The pivot block (80), shown in FIGS. 19 and 20, replaces the polyamide cubic shape pivot block (25) in the turning mechanism (11, 25, 26) described on PCT/ES2010/000187. The pivot block (80) has a rectangular shape on all its sides, and includes an off centered feature with respect to the lateral feces of the hole (138), where the door (24) axis is positioned, as the top and bottom axes must have a shift between them for the correct operation of the panes (2). The external sides of the pivot block (80), in contact with the vertical sides of the tracks (6, 7), have a flat face and the other two lateral sides (143, 144) have a protuberance (134) and a hole (135) each, on their bottom parts. The protuberances (134, 136) have identical shapes as well as the holes (135, 137) also have the same geometry so that the protuberances (134, 136) fit into the holes (135, 137). Moreover, one side (144) has a rectangular extension for obtaining a perfect coupling with the turning mechanism (81).

Figure 21:
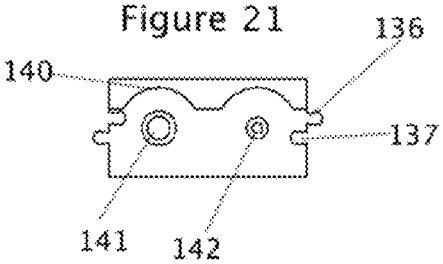
Figure 22:
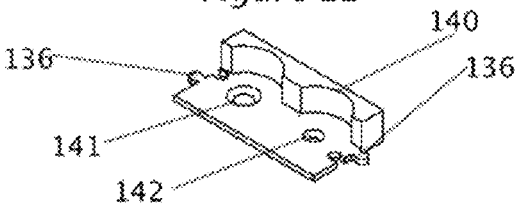
Figure 44:
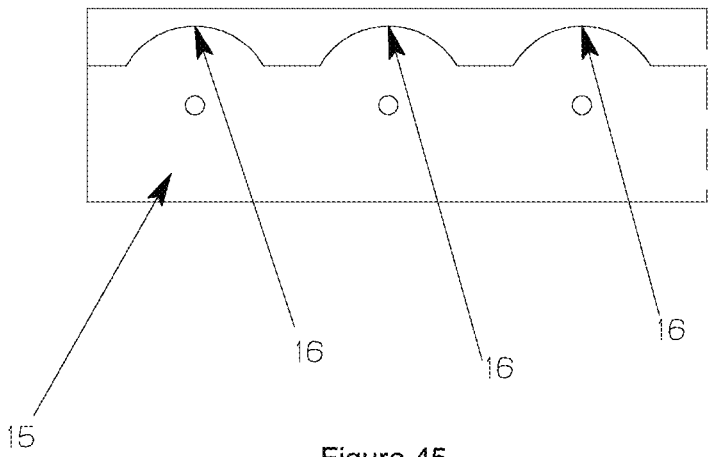
Figure 45:
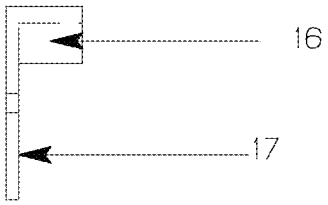
Figure 46:
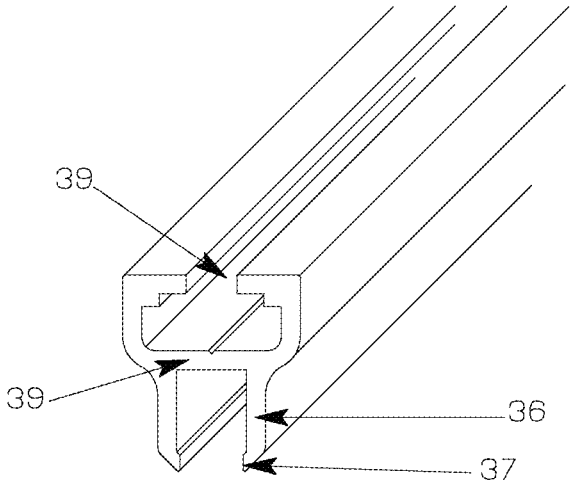
Figure 47:
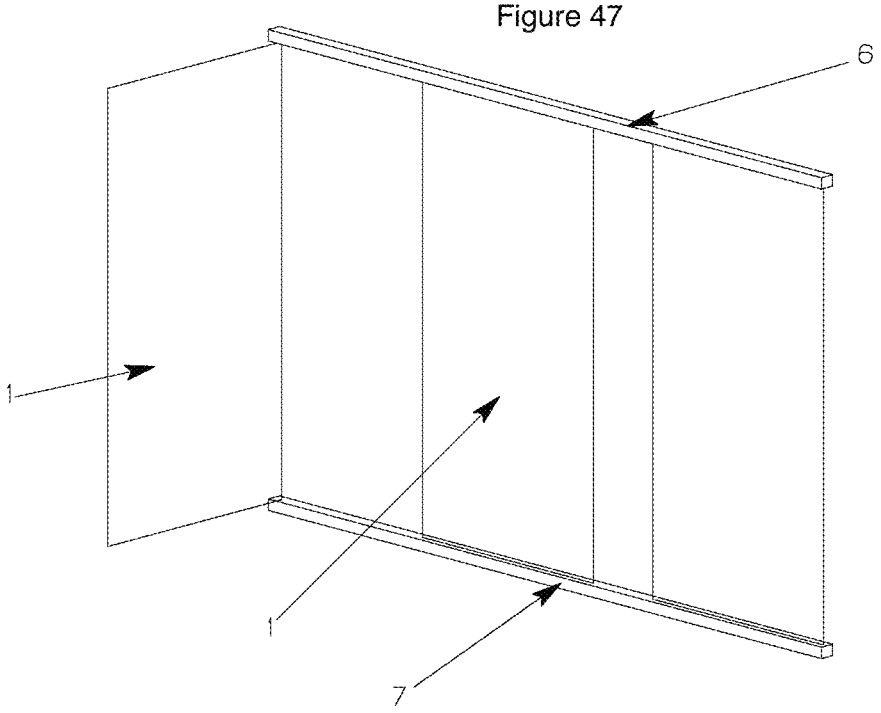
Figure 48:
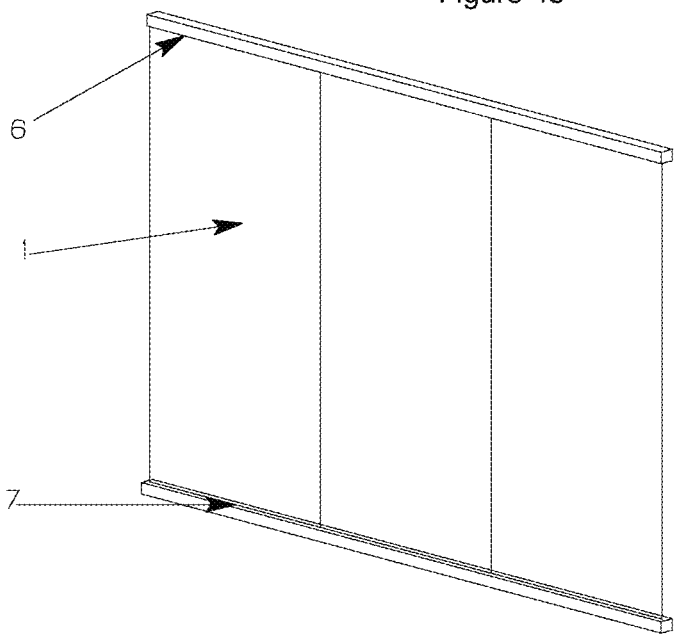
Figure 49:
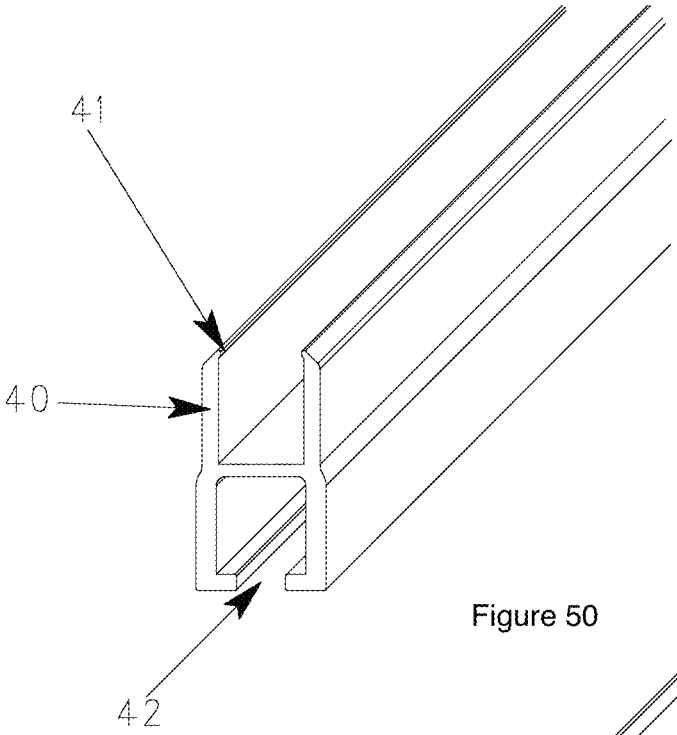
Figure 50:
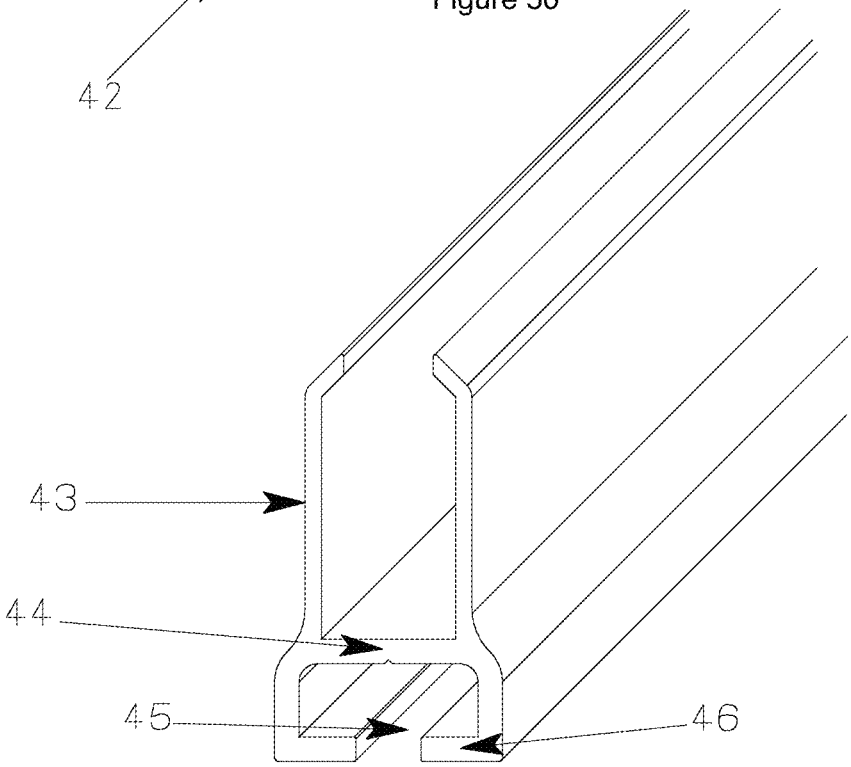

The new turning mechanism (81), shown in FIGS. 21 and 22, replaces the one shown in FIGS. 44 and 45. The turning mechanism (81) has the same protuberances (136) and holes (137) as the pivot block (80) but in a reverse position, so the pivot block (80) and the turning mechanism (81) can be assembled. When both parts (80, 81) are assembled they form a single block, so they cannot be separated. In the side remaining free after coupling to the pivot block (80), another turning mechanism (81) can be assembled and so on, until the necessary amount is obtained depending on the amount of panes (2) of the installation. The turning mechanism (81) has two holes (141, 142). The hole (141) closer to the block pivot (80) has a larger diameter than the other hole (142), and is used to secure the tracks (6, 7) to the floor and the ceiling, and the smaller hole (142) is used to secure the turning mechanism (81) to the tracks (6, 7). The turning mechanism (81) has two spoons (140) as in the previous version of the turning mechanism (15) disclosed on PCT/ES2010/000187.

Figure 23:
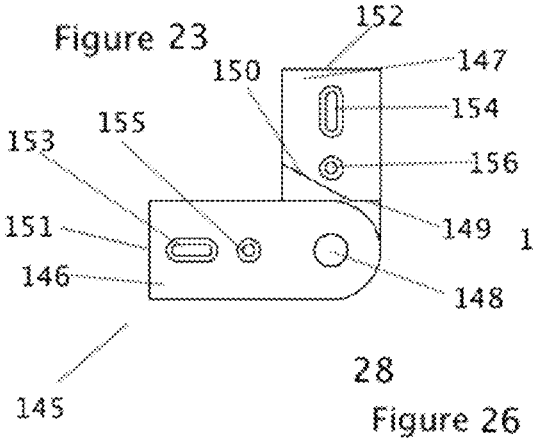
FIGS. 23 and 24: Two-part adjustable corner plate top plan and side elevation.
Figure 24:
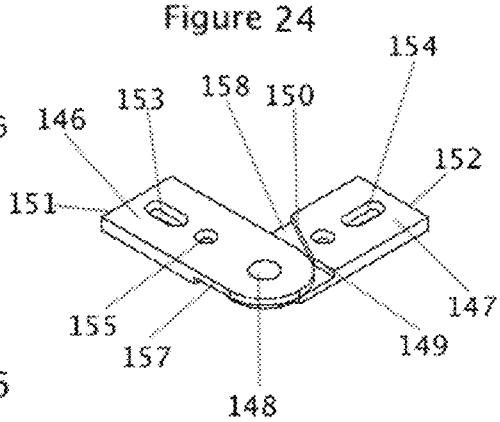
Figure 25:
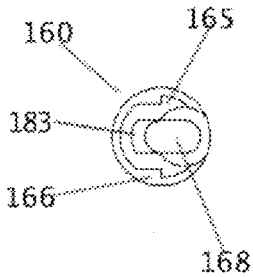
FIGS. 25, 26 and 27: Blocking bushing top plan, side view, and side elevation.

The new turning mechanism (81) and pivot block (80) set can be used on bottom part, FIGS. 22 and 23, and top part, FIGS. 24 and 25, of the windbreak system, as well as in any other possible opening configuration (right, left, interior, exterior) without any mechanical operation of the components. To achieve this, only the top pivot block (80) must be assembled to either side of the pivot block (81) and turning mechanism (81) and its protuberances (134, 136) and holes (135, 137), as the axis hole position is not symmetric in the longitudinal axis defined by the longest sides of the block. This way, the installation process is easier and more reliable than the one described on PCT/ES2010/000187. Moreover, mechanical operation is needed for proper fitting.

Figure 30:
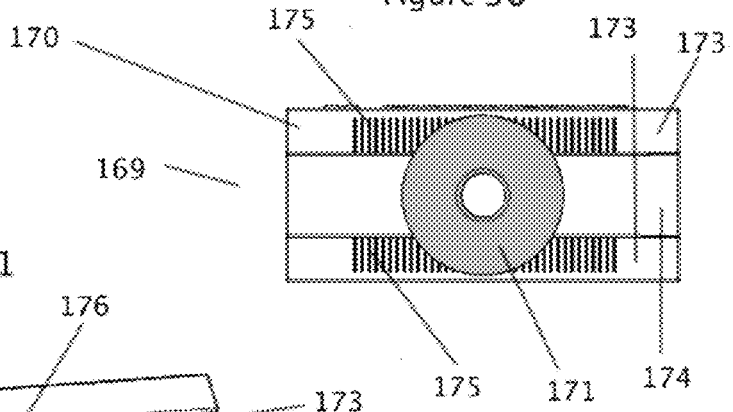
FIGS. 30 and 31: New bottom guide top plan and side elevation
Figure 31:
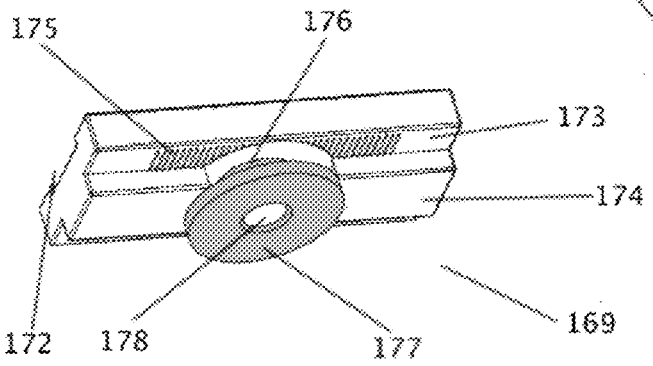

The tenth addition provides a two-part adjustable corner plate (145) used to couple different sections, and it can be used when there is an angle and two tracks must be connected. Moreover, the two-part adjustable corner plate ensures that both sections won't move once they are assembled during the operation of the system. FIGS. 30 and 31 show that the two-part adjustable corner plate has two identical plates (146, 147) connected by a joint element (148) formed in the plates (146, 147) with rounded shape sides. These round ends have a step so they can be coupled by means of the joint element. This step is delimited by two straight edges (149, 150) forming an interior angle of 270°. The angle formed by these two edges (149, 150) allows the set (145) to be used to articulate sections with two tracks (6, 7) within a range of 45° to 315°. The other small sides (151, 152) are straight and along the central axis of the plates (146, 147) an oval hole (153, 154) is provided, whose longer axis is parallel to the longer sides of the plate, and a circular hole (154, 155), being the oval holes closer to the small straight side of the plates (146, 147).

The oval hole (153, 154) is always used before the other hole when initially placing the plates (146, 147), as it allows regulation on the track connection process. The second hole (155, 156) is used for the final coupling of the set (145), once the tracks are properly connected. The plates (146, 147) are made as a single piece each by injection.

The eleventh addition provides a new top turning set that eliminates the need of using the guide-arm (23) when folding the panes as used in the previous system. The new set is formed by a metal axis (159) and a blocking bushing (160). The metal axis (159), shown in FIGS. 28 and 29, has a cylindrical shape with three different areas (161, 162, 163). The bottom area (161) of the axis has a semicircular shape to be coupled with a fixing plate (70). There are two wings (162) connected around the middle of the axis, with a ramp shape. This ramp will allow the blocking bushing (160) to elevate up the axis until it reaches the pivot position at the top turning mechanism (81) height. There is a head (163) with a small ramp at the top of the axis that will push the blocking bushing (160) down the axis when the pane is going to be deployed, so it can disengage from the top turning mechanism. The front side of the head (164) has a round shape that will block the pane (1) when folded, since the axis rotates approximately 90° in relation to the blocking bushing (160), being blocked to the interior semicircular faces (165).

Figure 26:
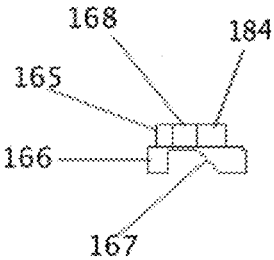
Figure 27:
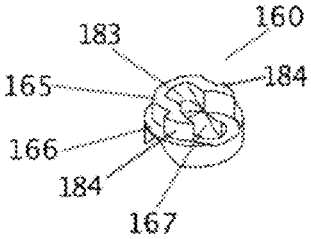
Figure 28:
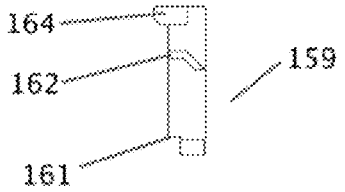
FIGS. 28 and 29: Metal axis side view and side elevation
Figure 29:
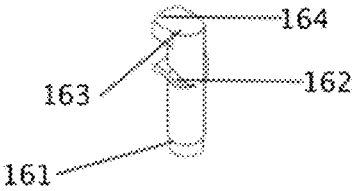

As shown in FIGS. 25 to 27, the blocking bushing (160) has a circular shape, with a central hole (168) and two layers (165, 166). The top plan view shows that the hole (168) has an oval shape with straight arms in such a way that this hole (168) is adjusted to the pass of to the metal axis (159). The first layer (165), with a larger diameter, has a ramp (167) that will elevate the bushing (160), as it moves up on, until the blocking bushing (160) reaches to the top turning mechanism (81) height. The second layer (165) is symmetric to the central vertical axis and has an interior ramp (167) in the inner hole (168) and two round sides (165) that block the metal axis (159) when the pane (1) starts the rotation movement. When the pane (1) is going to be deployed the central ramp (167) of the blocking bushing (160) will slide down along the axis head ramp (162) and will push down the blocking bushing (160), therefore leaving the top turning mechanism (81).

The metal axis (159) and the blocking bushing (160) are made as a single piece by injection ensuring that the part dimensions and symmetries are the right ones, providing a perfect operation and eliminating the possible differences in different production batches. As both parts (159, 160) form a set, it is not necessary to provide any tolerances, so that the pane (1) is perfectly blocked from the beginning of the folding movement, and the guide-arm (23) that holds the pane (1) during this movement is not longer necessary.

Figure 42:
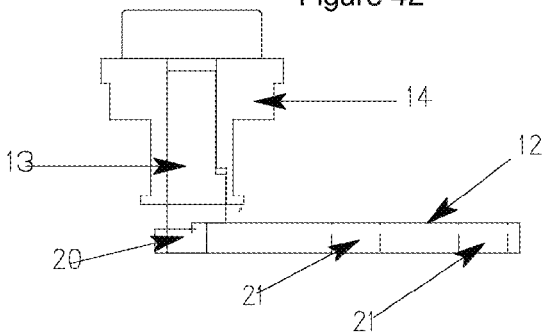
Figure 43:
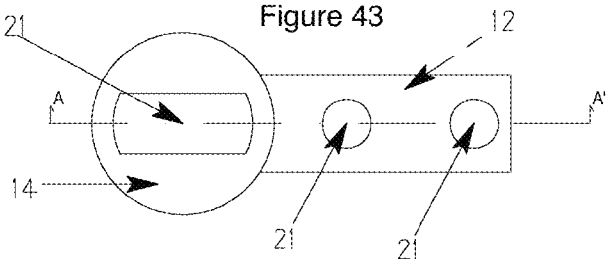

The twelfth addition comprises a new bottom guide (169), having a metal plate (170) and a washer (171), made of polyamide or similar material, as shown in FIGS. 30 and 31, that replaces the former one (12, 13, 14, 20, 21) as depicted in FIGS. 42 and 43. The base of the metal body (170) is a plate with two layers (173, 174). There are small teeth-like protuberances (175) on the first layer (173) of up to 0.5 mm long, that complete secures the set (169) to the aluminum bottom profile (5). The opposite side of the first layer (173) base has a channel (172) with a width equal to the width of the opening (45) of the aluminum bottom profile (5), so the pane (1) and the set (169) are both aligned. The height of the second layer (174) is the same as the thickness of the base of the bottom profile (5), so that when this plate is secured the layer (174) will be at the same level as the base of the bottom profile (5) making the base at this point, a flat continuous surface. The plate (170) is made as a single piece by injection to ensuring that all the dimensions and symmetries are correct. This way, the set will work properly and will eliminate the minor differences among the plates in different production batches.

The round-shape washer (171) is made of polyamide and has a hole along its vertical axis with two layers of different diameters. The larger diameter layer (177) is designed to keep the pane (1) aligned with the aluminum bottom track (7). The washer head (176) has a smaller diameter than the layer (177) and is used for coupling with the metal body (170), by an arrow lock or click system, preventing these parts (170, 171) from separating. Nevertheless, the washer (171) can rotate freely as its cylindrical interior hole (178) matches a cylindrical pin (not numbered in the figure) provided on the first layer (173) of the metal body (170) and with a height equal to the second layer (174).

This new bottom guide set (169) eliminates the need of providing a notch in one of the two sliding strips inserted in the bottom track, making this support area completely flat and continuous. This way the base of the bottom profile (5) won't hit or get stuck in the sliding strips during the pivoting movement, providing a smooth operation of the system. Moreover, the possibility of damaging the strips while folding the panes is eliminated.

Figure 32:
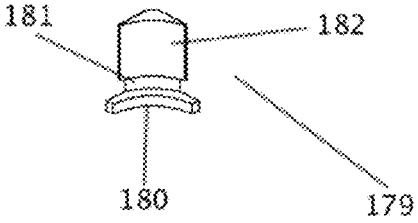
FIGS. 32 and 33: Curved wedge side elevation and side view
Figure 33:
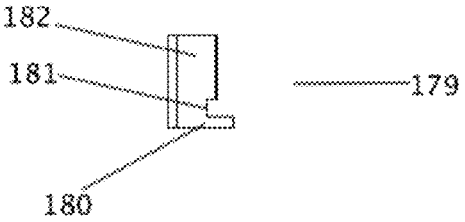
Figure 34:
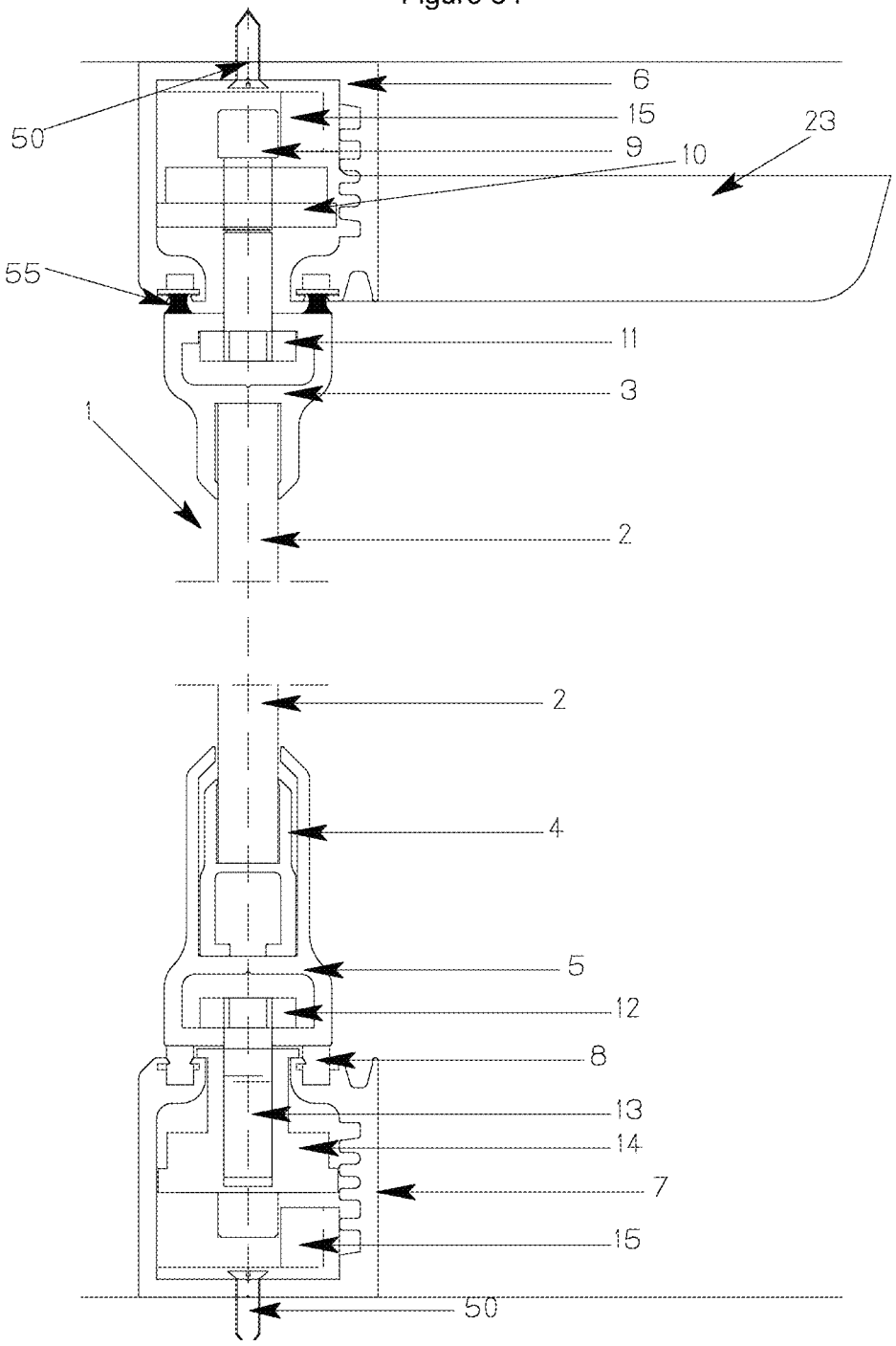
FIGS. 34 to 57: Parts from the initial patent request.
Figure 35:
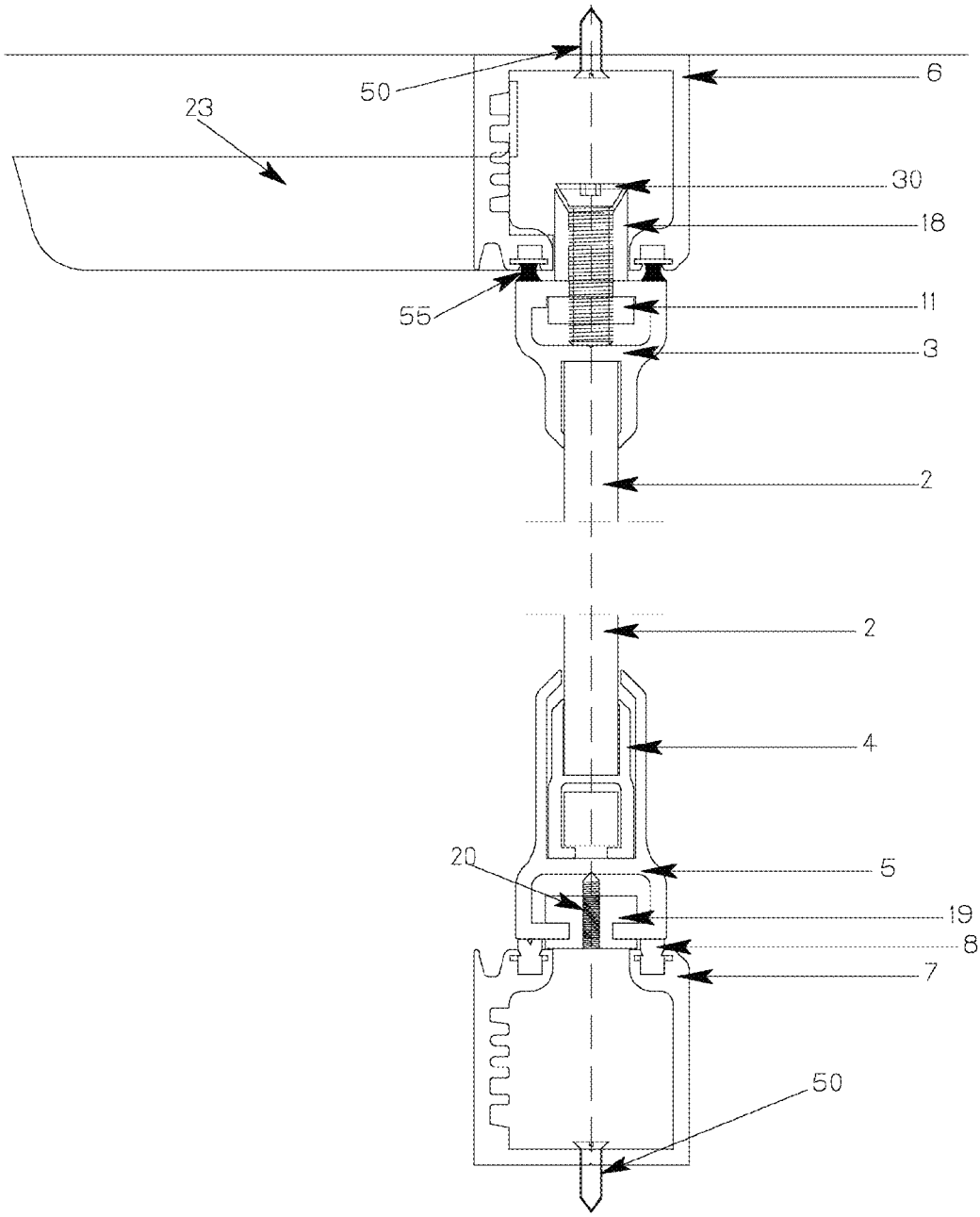
Figure 36:
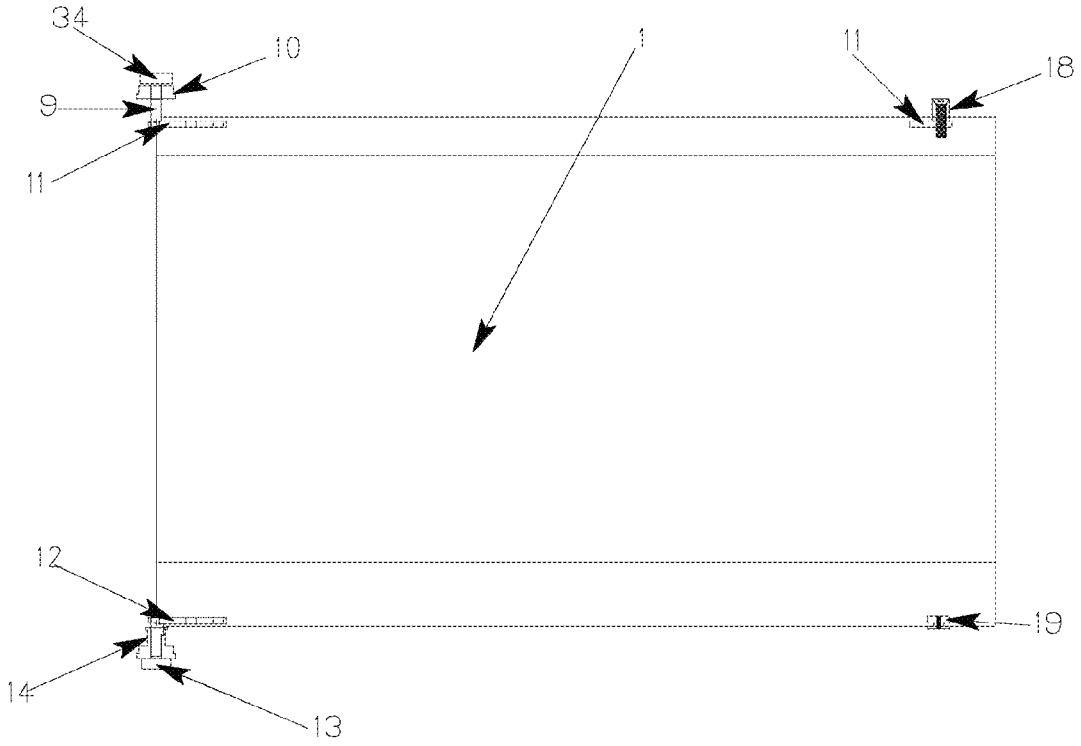
Figure 37:
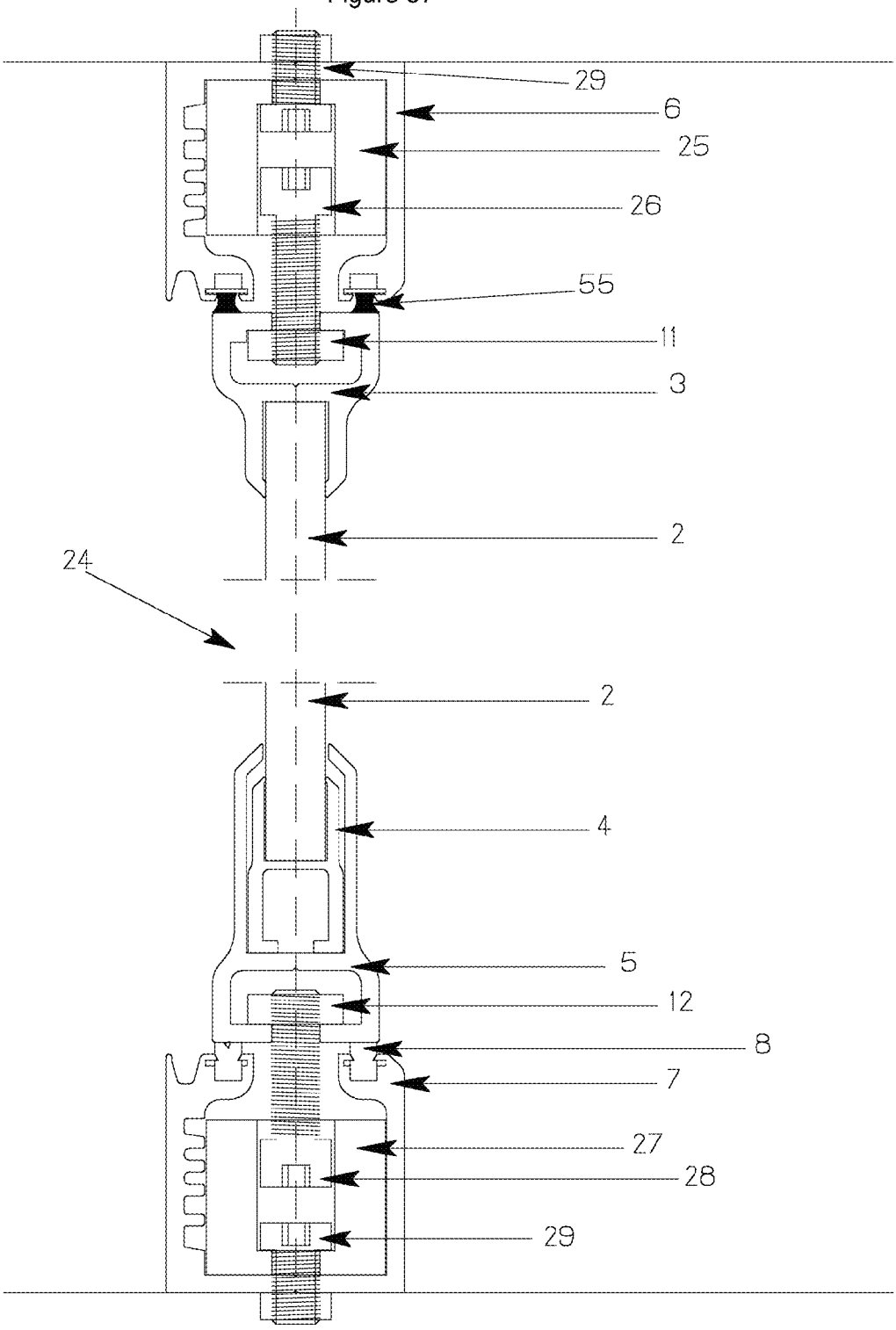
Figure 38:
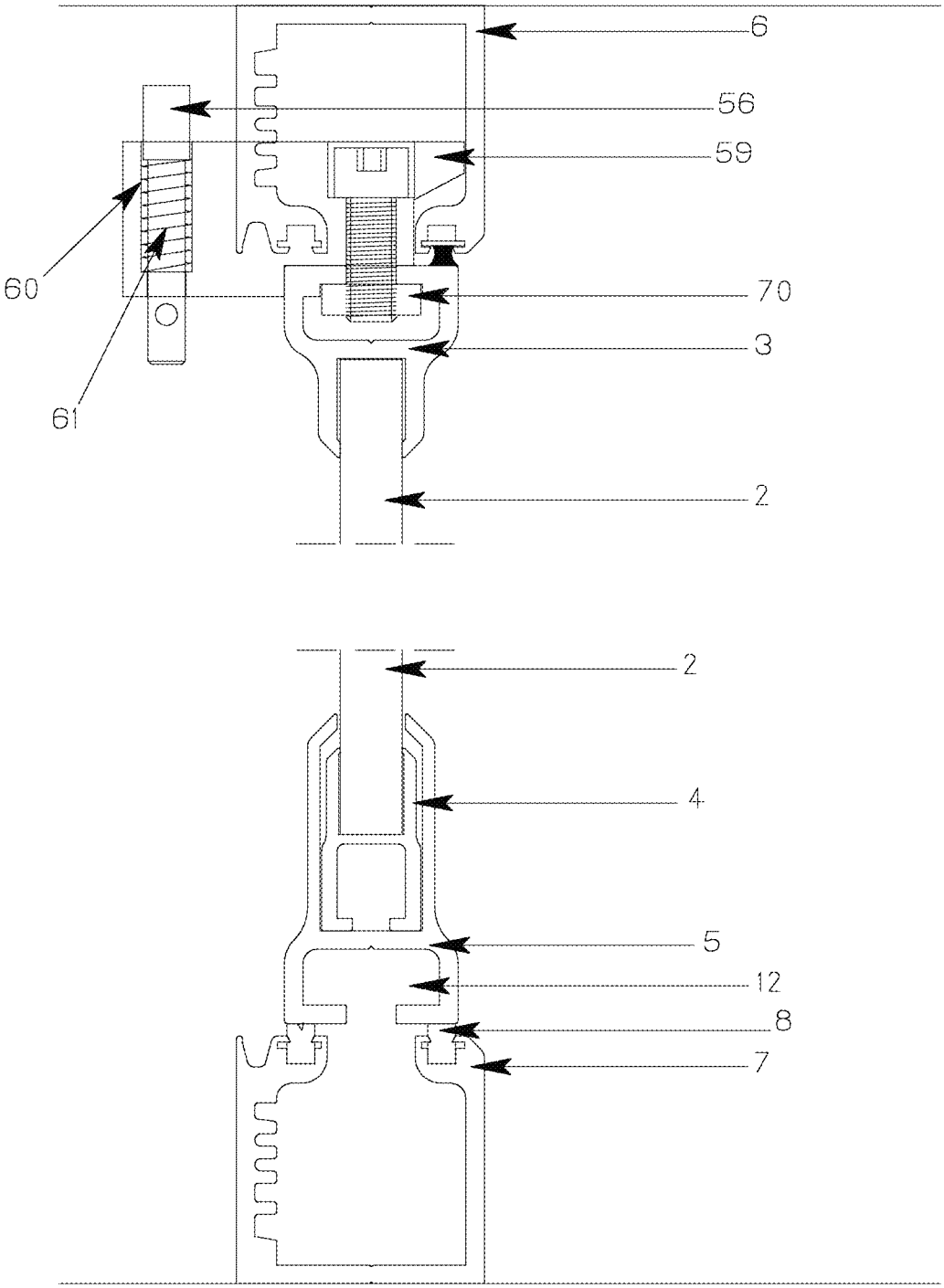
Figure 39:
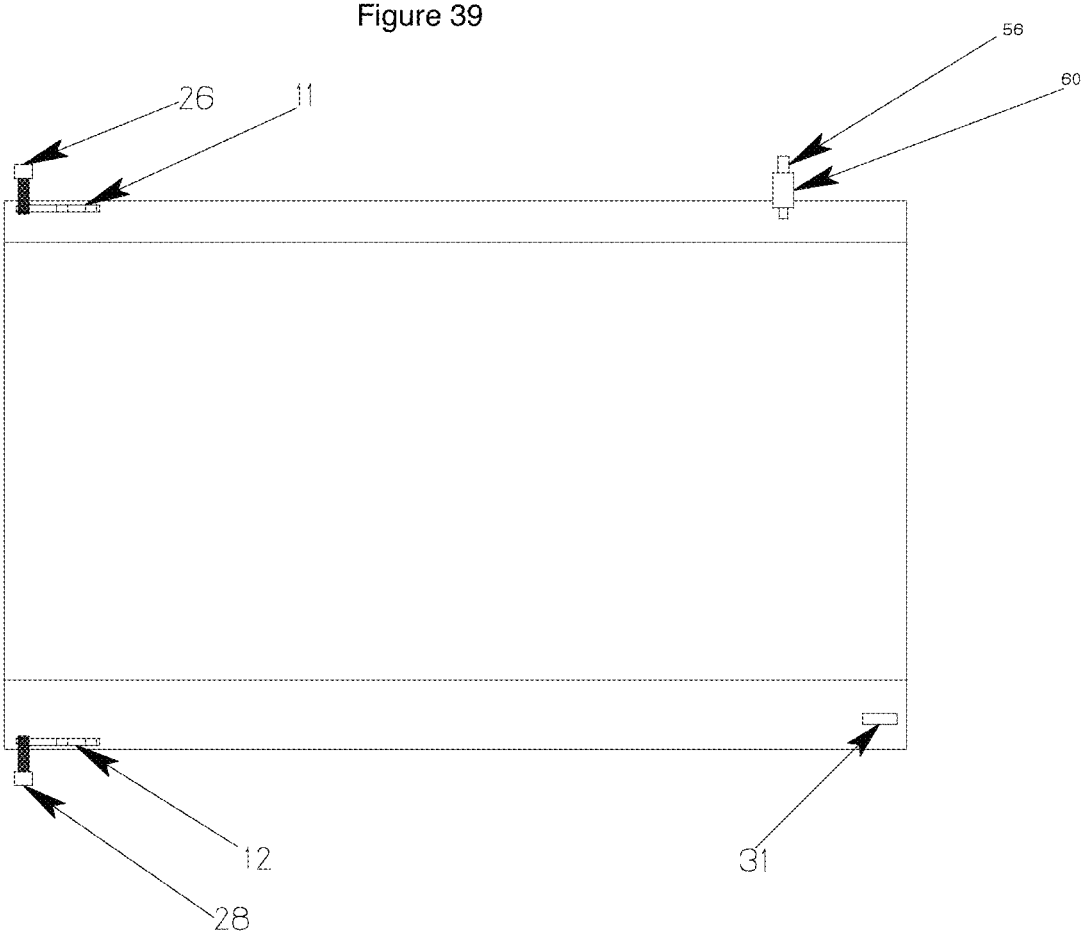
Figure 40:
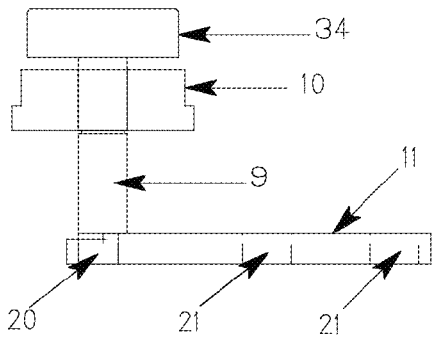
Figure 41:
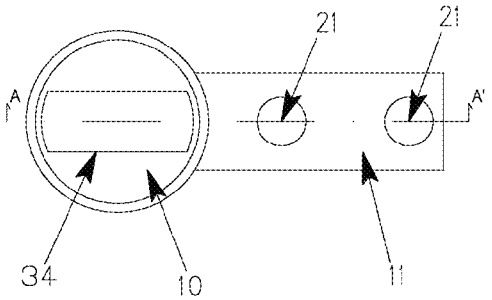

The thirteenth addition comprises a round-shaped wedge (179) that has three layers. As shown in FIGS. 32 and 33, first layer (180) is a base placed below the two-part adjustable corner plate (145). It has the round side for allowing the plates (146, 147) to move while connecting two tracks, and at the same time keep the wedge (179) at a fix position when the panes (1) pass along the corner. The second layer (181) connects the first layer (180) and a third layer (182) while filling the gap between the corner and the rounded plates (146, 147) when connecting two sections with angles. The third layer (182) has a round shape for preventing the bottom turning (76) bushing (109) to get stuck in the corner and pass along the tracks (7) smoothly from one section to another.

The rounded side wedge (179) is made as a single piece by injection for ensuring having the right dimensions for a perfect coupling with the two-part adjustable corner plate (145) and the bottom track (7), eliminating possible differences in measurements in different production batches.

This invention has an industrial application in the technical sector of construction mobile structures.

The invention claimed is:

1. A windbreak system comprising a set of foldable and independent panes sliding in a longitudinal direction along a top track and a bottom track that supports the weight of said panes, and a foldable and not sliding door, the panes and the door having respective pivot and folding axes;

wherein each of said independent panes and the door has a top profile, a bottom profile, and a glass pane, the glass pane being glued to inner surfaces of side arms and a flat base in the top profile, wherein the top profile side arms have toothed protuberances up to 0.5 millimeters long on the inner surfaces thereof, and a cavity on a top area of the top profile, the ends of said top profile side arms have two flat sides, and a bottom area of the top profile has an inverted U-shape hole for inserting and securing a top turning set and a top guide set; wherein each of said glass panes is also glued to inner surfaces of side arms and a flat base of a bottom aluminium profile, wherein the bottom profile side arms have toothed protuberances up to 0.5 mm long on the inner surfaces thereof and a bottom area of the bottom aluminium profile has an inverted U-shape hole for inserting two bolts that secure the bottom aluminium profile to the flat base of the bottom profile;

a bottom track and a top track, the bottom track and the top track being identical, each track having a rectangular cross-section with an opening formed on one side, wherein said opening is delimited by two equidistant sides of the track, wherein a first vertical wall of the track is flat and a second vertical wall of the track has a set of protuberances, the second vertical wall being equidistant from said first vertical wall along lengths thereof, wherein a side of the track is in contact with the ceiling or the floor and has a notched channel provided along an inner surface thereof opposite to said track opening, and an exterior surface of the side that forms said opening has three spaced apart parallel channels; wherein two strips made of a homogeneous mixture of self-lubricating polymer are provided in the bottom track, brushes are provided in the top track, and the bottom track has perforations parallel to the bottom track sides;

wherein said the top profile is connected, at the folding axis of the respective pane or door, to the top track by the top guide set, the top guide set formed by a metal body and a top guide bushing; wherein the metal body is a plate with two layers, an axis and a protuberance, toothed protuberances are provided on a first layer of the two layers, the first layer has a downward slope at its front end, and the width of a second layer of the two layers is the same as a width of the top track opening, wherein said top guide bushing has a circular shape and is a single piece made of polyamide that is inserted by pressure into a cylindrical axis head of the metal body, an outer diameter of the bushing having a width equal to the opening in the top track;

wherein said bottom profile is connected, at the folding axis of the respective pane or door, to the bottom track by a bottom guide set formed by a metal body and a washer made of polyamide; wherein a base of the metal body is a plate with two layers, toothed protuberances up to 0.5 mm long are provided on a first layer of the two layers, a side of the first layer has a channel with a width equal to the width of the opening of the aluminium bottom profile, and a height of the second layer of the metal body is the same as a thickness of the base of the bottom profile; wherein said washer has a round shape, a hole along its vertical axis, and two layers with different diameters, a base layer of the two layers of the washer has a larger diameter than that of a second layer and the washer head has a smaller diameter than said base layer, and said polyamide washer is inserted in the metal body of the bottom guide set by inserting a pin provided on the first layer of the metal body through a cylindrical interior hole of the washer, and the pin has a height equal to a height of the second layer of the washer.

2. The windbreak system according to claim 1, wherein said bottom track rests in a U-shaped levelling profile, resting on levelling sets formed by an eccentric bolt, the bottom track being sized to fit securely in a base of the levelling profile, and a flat head screw, all these sets rest completely on the base of the levelling profile; the levelling profile comprising a flat head screw and two corner holes for inserting a cap.

3. The windbreak system according to claim 2, wherein the pivot axis of each pane is formed by:

the top turning set, the top turning set having: a metal body and a top guide bushing, a metal body base comprising a plate with three layers and a protuberance comprising a wedge, wherein the first layer has a reference mark, toothed protuberances up to 0.5 mm long are provided in the second layer, and a width of the third layer corresponds to the opening of the top profile; wherein the top guide bushing has a circular shape and two layers, the bushing is inserted by pressure into a round metal head of the top turning set;

the bottom turning set having a bottom guide bushing, a metal body, and a second metal part with an oval shape and straight sides, wherein the metal body and second metal part are coupled by a square click locking joint, and a base of the metal body is a plate with three layers and a protuberance; wherein a reference mark is provided in the first layer, the second layer has protuberances on its surface and a width of the third layer is the same as that of the bottom profile opening, the protuberance of the metal body comprises a wedge, the bottom guide bushing has a T shape with flat side faces and round front and rear faces, wherein a bottom guide bushing width is smaller than the bottom aluminium track opening; the bottom guide bushing being centered, but not fixed, in relation to a bottom turning set axis;

a pivot block and turning mechanism, wherein the pivot block has a rectangular shape on all sides thereof, and a hole in which the door and independent pane axes are inserted, the hole being positioned off center, wherein external sides of the pivot block and two other sides of the pivot block have a protuberance and a hole for coupling with the turning mechanism; the pivot block having on one side a rectangular extension for matching the turning mechanism that has the same protuberances and holes as the pivot block but in a reverse position, including two holes, wherein the hole closer to the pivot block has a larger diameter than the hole further from the pivot block.

4. The windbreak systems according to claim 3, wherein the panes and the door pivot with the aid of a mechanism formed by a metal axis and a blocking bushing;

wherein said metal axis has a cylindrical shape with three different areas, a bottom area of the three areas has a semi-circular shape, two connected wings are provided in a middle area of the three areas, the connected wings having a ramp, and a head is provided at a top area of the three areas of the metal axis, the head being provided with a small ramp in a base thereof, wherein the front side of the head has a round shape and blocks the pane when folded, and the metal axis rotates approximately 90 degrees in relation to the blocking bushing, and is blocked by interior faces of the blocking bushing;

wherein the blocking bushing has a circular shape, a central hole, and two layers, the central hole having an oval shape with straight sides corresponding to the metal axis, a first layer of the two layers of the blocking bushing having a ramp that rests on the ramp of the metal axis, a second layer of the two layers being symmetrical relative to a central vertical axis thereof and having an interior ramp in the central hole, wherein the two interior faces that block the metal axis are rounded.

5. The windbreak system according to claim 4, further comprising a door locking system, wherein the door locking system includes a top locking block made as a single piece by injection, the top locking block comprising a rectangular parallelepiped with two protuberances and a short semi-circular side with a first top locking block hole, the first top locking block hole having a larger diameter than a second top locking block hole that is located on the top side of the top locking block, opposite to the protuberances of the block, wherein one of the protuberances is provided to position the top locking block perpendicular to the top profile, and the other of the protuberances is located on a front side of the top locking block and serves as a stopper against the internal faces of the top profile.

6. The windbreak system according to claim 2, wherein a cap is placed at ends of the bottom track, the cap having the same shape is as the ends of the bottom track, wherein a bottom side of the cap is flat and a top side of the cap is narrow so that it can fit into holes at the ends of the bottom track, one vertical side of the cap is flat, and an opposite vertical side has a contour with protuberances complementary to the protuberances of the bottom track.

7. The windbreak system according to claim 3, further comprising a two-part adjustable corner plate having two identical plates connected by a joint element formed in a longer side of each plate and having a step delimited by two straight edges forming an interior angle of 270 degrees, wherein opposing sides of each plate is straight, and an oval hole is positioned along a central axis of the plates, a major axis of said oval hole being parallel to the longer sides of the plate, the corner plate further comprising a circular hole, wherein the oval holes are closer to the opposing sides of the plates.

8. The windbreak system according to claim 7, wherein each wedge has three layers, wherein the first layer is a base placed below the two-part adjustable corner plate, the second layer is shorter and narrower than the other two layers and the third layer has a rounded shape.

9. The windbreak system according to claim 7, wherein the top turning set metal body, the two metal bodies in the bottom turning set, the caps, the locking block, the turning mechanism, the pivot block, the two-part adjustable corner plate, the metal axis, the blocking bushing, the plate in the bottom guide and the wedges are made as a single piece by injection using aluminium, stainless steel or other metal alloys.

* * * * *